US012448869B2

(12) United States Patent
Kang et al.

(10) Patent No.: US 12,448,869 B2
(45) Date of Patent: Oct. 21, 2025

(54) $CO_2$ OPERATION TEMPERATURE AND PRESSURE ANALYSIS AND WELL DESIGN WITH $CO_2$ MODELING WITH EQUATION OF STATE METHOD

(71) Applicant: Landmark Graphics Corporation, Houston, TX (US)

(72) Inventors: Yongfeng Kang, Houston, TX (US); Adolfo Gonzales, Houston, TX (US); Robello Samuel, Houston, TX (US); Zhengchun Liu, Houston, TX (US)

(73) Assignee: Landmark Graphics Corporation, Houston, TX (US)

( * ) Notice: Subject to any disclaimer, the term of this patent is extended or adjusted under 35 U.S.C. 154(b) by 1028 days.

(21) Appl. No.: 17/607,545

(22) PCT Filed: Jan. 29, 2020

(86) PCT No.: PCT/US2020/015660
§ 371 (c)(1),
(2) Date: Oct. 29, 2021

(87) PCT Pub. No.: WO2021/040783
PCT Pub. Date: Mar. 4, 2021

(65) Prior Publication Data
US 2022/0220830 A1 Jul. 14, 2022

Related U.S. Application Data

(60) Provisional application No. 62/891,108, filed on Aug. 23, 2019.

(51) Int. Cl.
*E21B 41/00* (2006.01)
*E21B 43/26* (2006.01)
*E21B 47/06* (2012.01)

(52) U.S. Cl.
CPC ..... *E21B 41/0064* (2013.01); *E21B 43/26* (2013.01); *E21B 47/06* (2013.01); *E21B 2200/20* (2020.05)

(58) Field of Classification Search
CPC ..... E21B 41/0064; E21B 43/26; E21B 47/06; E21B 2200/20; E21B 41/00
See application file for complete search history.

(56) References Cited

U.S. PATENT DOCUMENTS

2011/0186295 A1* 8/2011 Kaminsky ..... E21B 43/2401 166/302
2014/0214326 A1* 7/2014 Samuel ..... E21B 47/006 702/11

(Continued)

FOREIGN PATENT DOCUMENTS

WO 2021040783 A1 3/2021

OTHER PUBLICATIONS

Li XiaoJiang LX, Li GenSheng LG, Wang HaiZhu WH, Tian ShouCeng TS, Song XianZhi SX, Lu PeiQing LP, Wang Meng Wm. A unified model for wellbore flow and heat transfer in pure CO2 injection for geological sequestration, EOR and fracturing operations. (Year: 2017).*

(Continued)

*Primary Examiner* — Chuen-Meei Gan
(74) *Attorney, Agent, or Firm* — Conley Rose, P.C.; Rodney B. Carroll

(57) ABSTRACT

A system for designing a casing string for a well. The system comprises a processor, a non-transitory memory, a thermodynamic modeling application stored in the non-transitory memory that, when executed by the processor, models carbon dioxide ($CO_2$) material in the well using a carbon dioxide equation of state (EoS) to determine thermodynamic properties of the $CO_2$ material, and a downhole environment modeling application stored in the non-transitory memory (Continued)

that, when executed by the processor determines temperatures of and pressures at well components at each of a plurality of points of a casing string design based in part on the thermodynamic properties of the $CO_2$ material determined by the thermodynamic modeling application, and provides the temperatures of well components and pressures in the casing string at each of the plurality of points of the casing string to a casing string strength analysis application executing on the computer system.

20 Claims, 12 Drawing Sheets

(56) References Cited

U.S. PATENT DOCUMENTS

2016/0203239 A1* 7/2016 Samuel ..... E21B 43/10 703/1
2018/0142536 A1 5/2018 Liu et al.

OTHER PUBLICATIONS

Asamoto S, Le Guen Y, Poupard O, Capra B. Well integrity assessment for CO2 injection: A numerical case study on thermo-mechanical behavior in downhole CO2 environments. Engineering Computations. Aug. 16, 2013;30(6):842-53. (Year: 2013).*

Aursand P, Hammer M, Lavrov A, Lund H, Munkejord ST, Torsæter M. Well integrity for CO2 injection from ships: Simulation of the effect of flow and material parameters on thermal stresses. International Journal of Greenhouse Gas Control. Jul. 1, 2017;62:130-41. (Year: 2017).*

Tantuoyir MM. Heat Transfer Modeling and Simulation in Geothermal Wells (Master's thesis, University of Stavanger, Norway). (Year: 2018).*

Span, R. et al., "A New Equation of State for Carbon Dioxide Covering the Fluid Region from the Triple-Point Temperature to 1100 K at Pressures up to 800 MPa," Journal of Physical and Chemical Reference Data, 1996, vol. 25, No. 6, pp. 1509-1596, American Institute of Physics and American Chemical Society.

Giljarhus, Knut Erik Teigen et al., "Solution of the Span-Wagner Equation of State Using a Density-Energy State Function for Fluid-Dynamic Simulation of Carbon Dioxide," Industrial & Engineering Chemistry Research, 2012, vol. 51, pp. 1006-1014, American Chemical Society.

Kang, Yongfeng, Filing Receipt, Specification and Drawings for U.S. Appl. No. 62/891,108, filed Aug. 23, 2019, titled "CO2 Operation Temperature and Pressure Analysis and Well Design With CO2 Modeling With Equation of State Method," 47 pages.

Foreign Communication from Related Application—International Search Report and Written Opinion of the International Searching Authority, International Application No. PCT/US2020/015660, dated Jan. 29, 2020, 12 pages.

* cited by examiner

| MultiString Annular Expansion Summary-$CO_2$ Injection | | | | | | | | |
|---|---|---|---|---|---|---|---|---|
| | String Annulus | Region | | | Device Failure | | Incremental AFE Pressure (1) (psi) | Incremental AFE Volume (2) (bbl) |
| | | | Top (ft) | Base (ft) | Disk | Foam | | |
| 1 | 20" Surface Casing | Region 1 | 40.00 | 450.00 | - | - | 3.00 | 0.0 |
| 2 | 13 3/8" Intermediate Casing | Region 1 | 40.00 | 6000.00 | - | - | -21.00 | -0.8 |
| 3 | 9 5/8" Protective Casing | Region 1 | 40.00 | 9500.00 | - | - | -30.00 | -3.1 |
| 4 | 7" Production Tieback | Region 1 | 40.00 | 14800.00 | - | - | -36.00 | -3.3 |
| 5 | 3 1/2" Production Tubing | Region 1 | 40.00 | 17000.00 | - | - | -21.00 | -6.3 |
| 6 | | | | | | | | |
| 7 | (1) Pressure change caused solely by the Annular Fluid Expansion (AFE) phenomenon. | | | | | | | |
| 8 | (2) Volume change caused solely by the Annular Fluid Expansion (AFE) effect. | | | | | | | |

*FIG. 13*

$CO_2$ OPERATION TEMPERATURE AND PRESSURE ANALYSIS AND WELL DESIGN WITH $CO_2$ MODELING WITH EQUATION OF STATE METHOD

CROSS-REFERENCE TO RELATED APPLICATIONS

This application is a filing under 35 U.S.C. 371 of International Application No. PCT/US2020/015660 filed Jan. 29, 2020, which claims priority to U.S. Provisional Application No. 62/891,108 filed Aug. 23, 2019, both entitled "$CO_2$ Operation Temperature and Pressure Analysis and Well Design with $CO_2$ Modeling With Equation Of State Method," both of which are incorporated by reference herein in their entirety.

BACKGROUND

Well operations include a variety of procedures including drilling a hole in the ground, taking various measurements of the hole and abutting subterranean formations (e.g., well logging), casing the wellbore, cementing the casing in the wellbore, perforating the casing, hydraulic or chemical fracturing of one or more subterranean formations, performing hydrocarbon enhanced recovery operations such as fluid injection, propping a fractured formation with proppants, setting completion tools in the wellbore and/or casing string, producing hydrocarbons and/or water from the wellbore, maintaining completion tools (e.g., replacing an electric submersible pump (ESP)), and other operations.

BRIEF DESCRIPTION OF THE DRAWINGS

FIG. 13 is an illustration of an exemplary user interface screen that presents annulus fluid expansion (AFE) and annulus pressure buildup (APB) results according to embodiments of the disclosure.

DETAILED DESCRIPTION OF THE INVENTION

Figure 1:
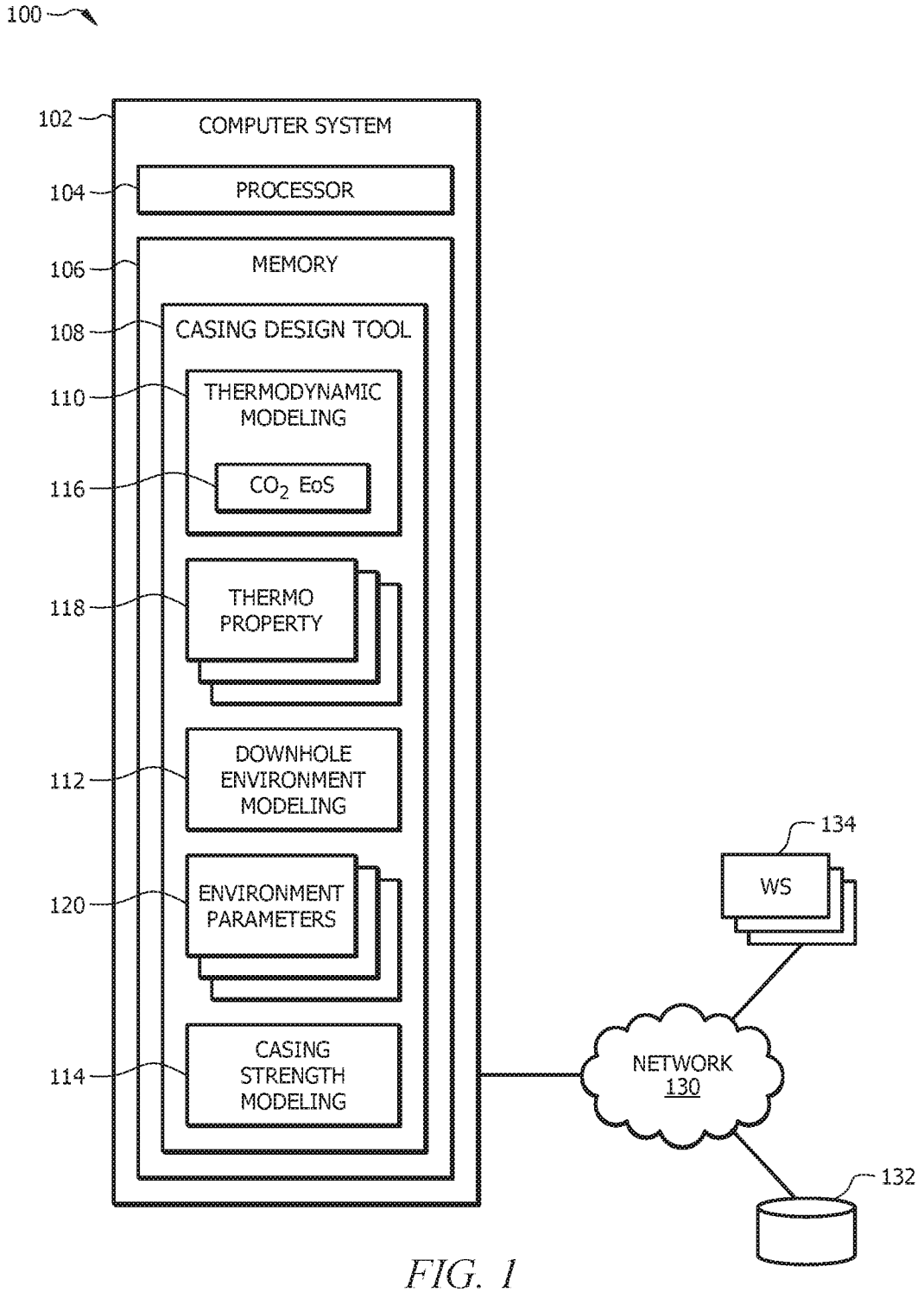
FIG. 1 is a block diagram of a system according to embodiments of the disclosure.

Disclosed herein is a method and system to calculate temperatures and pressures at different locations or depths of a wellbore and during different wellbore operations. One of the wellbore operations may be injection and/or circulation of $CO_2$ gas to enhance recovery of hydrocarbons from one or more subterranean formations. Wellbores are desirably cased with casing pipe to maintain the wellbore and promote installation of production equipment. Wellbores may be associated with oil wells, gas wells, oil and gas wells, and geothermal wells. A casing string is desirably designed for a wellbore taking into consideration a variety of factors including the wellbore trajectory, wellbore dimensions, environment conditions in the wellbore, planned wellbore operations, a design lifetime or life expectancy of the casing string, and economic considerations. A variety of mechanical stresses and chemical attacks desirably are considered in analyzing a casing string design. While it is desirable that a casing string design be adequate to achieve life expectancy goals and sustain stresses of wellbore operations, it is also desirable that the casing string design not be over-designed, designed with excessive robustness, because over-design may be associated with unnecessary materials costs and hence economic inefficiency. Computer automated wellbore casing design tools exhibit undesirable inaccuracy when analyzing casing safety factors related to $CO_2$ injection and/or circulation operations. In fact, some computer automated wellbore casing design tools may not support any analysis related to $CO_2$ injection and/or circulation operations. Therefore a need exists for a computer automated wellbore casing design tool that supports improved accuracy of analysis of $CO_2$ injection and/or circulation operations.

The present disclosure teaches a computer automated wellbore casing design tool that models $CO_2$ operations using an equation of state (EoS) specifically adapted to $CO_2$ to achieve improved accuracy in analysis of and in determining safety factors for wellbore casing strings during $CO_2$ injection and/or circulation operations. In embodiments, a computer automated casing design tool employs the Span-Wagner $CO_2$ EoS in a thermodynamic modeling application to estimate $CO_2$ thermodynamic properties during $CO_2$ operations in a wellbore. A downhole environment modeling application of the computer automated tool uses the estimated $CO_2$ thermodynamic properties to estimate temperature and pressure values at different points in the wellbore and along the length of the casing string during $CO_2$ operations in the wellbore. A casing strength modeling application of the computer automated tool uses the estimated temperature and pressure values to determine casing string safety factors at different points in the casing string during $CO_2$ operations.

Casing string safety factors may be calculated for a plurality of different stress types. Casing burst strength, casing collapse strength, casing axial strength, and casing triaxial strength safety factors may be calculated at different points in the casing string for $CO_2$ operations and for other operations. The minimum safety factors for each different stress type may be determined for each of a plurality of casing string locations (e.g., different wellbore depths) and presented in a safety factor table to a user of the computer automated wellbore casing design tool. The casing designer may use the safety factor table and/or a safety envelope graphical depiction of the results of the safety factor table to evaluate a casing string design. The casing designer may adapt one or more elements of a casing string design and reiterate the analysis, whereby to optimize a casing string design to achieve desired safety factors with suitable casing string service life and with desirable economic efficiency (e.g., avoiding over-design). The increased accuracy associated with using the $CO_2$ EoS in the thermodynamic modeling application promotes better optimization of the casing string design by providing more accurate estimation of thermodynamic properties during $CO_2$ operations.

The results of the thermodynamics modeling application are handed-off or made available to the downhole environment modeling application, and the results of the downhole environment modeling application are handed-off or made available to the casing strength modeling application, which may be referred to as integrating the applications with each other. In some other computer automated casing design and/or analysis tools, a user may be obliged to manually feed outputs of one tool as inputs to another tool. Said in other words, other computer automated casing design and/or analysis tools may not provide integration of distinct modeling applications that generate intermediate data results that serve as inputs to other modeling and/or analysis applications. The integrated aspect of the disclosed computer automated wellbore casing design tool contributes to increased user satisfaction and increased casing designer/engineer productivity.

Turning now to FIG. 1, a system 100 is described. In embodiments, the system 100 includes a computer system 102 that includes a processor 104 and a memory 106. Computer systems are described further hereinafter. The memory 106 includes a non-transitory portion and may further include a transitory portion. The non-transitory portion of the memory 106 stores a casing design tool 108. In embodiments, the casing design tool 108 includes a thermodynamic modeling application 110, a downhole environment modeling application 112, and a casing strength modeling application 114. It is understood that the casing design tool 108 may include additional applications or components (not shown) such as an application programming interface (API). The computer system 102 is communicatively coupled to a network 130 that includes one or more private networks, one or more public networks, or a combination thereof.

The system 100 may include a data store 132 and a plurality of work stations 134. The work stations 134 may be implemented as computer systems, for example desktop computers, laptop computers, tablet computers, and/or notebook computers. The work stations 134 are able to communicate with the casing design tool 108 via the network 130, for example via an API provided by the casing design tool 108. The computer system 102 and/or the thermodynamic modeling application 110 is able to communicate with the data store 132 via the network 130.

The thermodynamic modeling application 110 includes a $CO_2$ equation of state (EoS) 116 that may be used by the thermodynamic modeling application 110 to model thermodynamic behavior of $CO_2$, for example during $CO_2$ operations such as $CO_2$ injection downhole and $CO_2$ circulation. In embodiments, the $CO_2$ EoS 116 is a Span-Wagner $CO_2$ EoS or is derived from the Span-Wagner $CO_2$ EoS. Further details on the Span-Wagner $CO_2$ EoS are provided hereinafter. In other embodiments, however, a different $CO_2$ EoS may be configured as the $CO_2$ EoS 116 in the thermodynamic modeling application 110. When the casing design tool 108 executes to estimate the safety factors associated with a $CO_2$ operation, the thermodynamic modeling application 110 may use the $CO_2$ EoS 116 to estimate and/or determine thermodynamic properties 118 of the $CO_2$ at different points in the wellbore and/or in a casing string deployed into the wellbore.

The thermodynamic modeling application 110 may estimate and/or determine the thermodynamic properties 118 of the $CO_2$ based in part on a specification of the wellbore and of the casing string. This specification may be stored in the data store 132. The specification may include information about a trajectory of the wellbore, dimensions of the wellbore, information about geothermal temperatures at different depths of the wellbore, lengths of segments of a casing string, diameters of segments of the casing string, steel type used in segments of the casing string, pipe grade or pipe type of segments of the casing string, pipe thickness of segments of the casing string, and other characteristics of the wellbore and/or casing string. It is understood that the data store 132 may store specifications associated with a plurality of different wells and/or wellbores and that the casing design tool 108 may be configured, at least in part, to analyze a casing design for any of these other wells and/or wellbores by reading the appropriate specification from the data store 132.

These thermodynamic properties 118 estimated and/or determined by the thermodynamic modeling application 110 may include one or more of a density, an internal energy, an enthalpy, an entropy, a heat capacity at constant volume, a heat capacity at constant pressure, a Joule-Thomson coefficient, a speed of sound in the $CO_2$, and/or a phase change boundary. In embodiments, the thermodynamic properties 118 include at least three members of the list of properties consisting of a density, an internal energy, an enthalpy, an entropy, a heat capacity at constant volume, a heat capacity at constant pressure, a Joule-Thomson coefficient, a speed of sound in the $CO_2$, and a phase change boundary. In embodiments, the thermodynamic properties 118 may include additional properties. The thermodynamic properties 118 determined by the thermodynamic modeling application 110 may be associated to contextual cues such as a time and/or a location in the wellbore or along the casing string. Said in other words, each different thermodynamic property parameter data generated by the thermodynamic modeling application 110 may include a value, a thermodynamic property identity, a time, and a location. In embodiments, the thermodynamic modeling application 110 determines thermodynamic properties 118 for each of a plurality of different wellbore and/or casing string operating modes including $CO_2$ operations.

The downhole environment modeling application 112 may receive the thermodynamic properties 118 from the thermodynamic modeling application 110, for example via an API provided by the environment modeling application 112. Alternatively, the downhole environment modeling application 112 may access the non-volatile portion of the memory 106 to read the thermodynamic properties 118. The downhole environment modeling application 112 estimates or determines environment parameters 120 based on analyzing the thermodynamic properties 118 and based on the specification of wellbore and the casing string. The environment parameters 120 include temperatures and pressures experienced by the casing string at different places in the wellbore. In embodiments, the downhole environment modeling application 112 determines environment parameters

120 for each of a plurality of different wellbore and/or casing string operating modes including $CO_2$ operations.

The casing strength modeling application 114 may receive environment parameters 120 from the downhole environment modeling application 112, for example via an API provided by the casing strength modeling application 114. Alternatively, the casing strength modeling application 114 may access the non-volatile portion of the memory 106 to read the environment parameters 120. The casing strength modeling application 114 determines stresses experienced by the casing string at different points in the casing string in different operating modes including during $CO_2$ operations and calculates safety factors associated with different points in the casing string. The casing strength modeling application 114 may determine worst case safety factors (e.g., lowest value) for each depth across all the operations and present this information in a safety factor result table and/or in a graphical form as a safety envelope graph. In embodiments, the thermodynamic modeling application 110, the downhole environment modeling application 112, and the casing strength analysis application 114 are integrated with each other.

In this disclosure, the properties of the pure $CO_2$ are calculated based on a set of equation of state (EoS) formulas proposed by Span and Wagner, 1996. The set of EOS is in the form of a fundamental equation explicit in the Helmholtz free energy and covers the fluid region from the triple point temperature to 1100 K at pressures up to 800 MPa. In the technically most important region up to pressures of 30 MPa and up to temperatures of 523 K, the estimated uncertainty of the equation ranges from ±0.03% to ±0.05% in the density, ±0.03% to ±1% in the speed of sound, and ±0.15% to ±1.5% in the isobaric heat capacity. Span and Wagner claim, for at least the basic properties such as pressure, fugacity, and enthalpy, that their EoS can be extrapolated up to the limits of the chemical stability of carbon dioxide. So that the EoS could calculate very accurate properties for the pure $CO_2$ for thermodynamic pressure, temperature and density, specific isobaric heat capacity, specific isochoric heat capacity, speed of sound, entropy, enthalpy, internal energy, Joule-Thomson coefficient, saturated liquid heat capacity, fugacity, etc. A brief summary of the set of the EoS is described below.

The EoS used in this disclosure is in form of the Helmholtz energy A(ρ, T) with the two independent variables density ρ and temperature T. The dimensionless Helmholtz energy Ø=A/(RT) is expressed with a part of ideal-gas behavior Ø° and a part of the residual fluid behavior $Ø^r$ as below with detailed equations for each part is given in later.

$$\phi(\delta, \tau) = \frac{A(\rho, T)}{RT} = \phi^o(\delta, \tau) + \phi^r(\delta, \tau) \tag{1}$$

Where $$\delta = \frac{\rho}{\rho_c}$$

is the reduced density with the critical density $$\tau = \frac{T_c}{T}$$

is the inverse reduced density with the critical temperature

R is the specific gas constant, $$R = \frac{R_m}{M} = (0.1889241 \pm 0.0000116)\ \text{kJ/(kg}\cdot\text{K)}$$

$R_m$ is the molar gas constant, $R_m$=(8.314510±0.000210) J/(mol·K)

M is the $CO_2$ molar mass, M=(44.0098±0.0016) g/mol

The Helmholtz energy as a function of density and temperature is one form of a fundamental equation, so that all the thermodynamic properties of a pure substance can be obtained by combining derivative of the above Eq (1) as listed below table 1.

TABLE 1 relations of thermodynamic properties to the dimensionless Helmholtz function

| Property and common thermodynamic definition | Relation to the reduced Helmholtz energy Ø and its derivatives |
|---|---|
| Pressure: $p(T, \rho) = -(\partial A/\partial \upsilon)_T$ | $\frac{p(\delta, \tau)}{\rho RT} = 1 + \delta\phi^r_\delta$ |
| Entropy: $s(T, \rho) = -(\partial A/\partial T)_\upsilon$ | $\frac{s(\delta, \tau)}{R} = \tau(\phi^\upsilon_\tau + \phi^r_\tau) - \phi^0 - \phi^r$ |
| Internal energy: $u(T, \rho) = A - T(\partial A/\partial T)_\upsilon$ | $\frac{u(\delta, \tau)}{RT} = \tau(\phi^0_\tau + \phi^r_\tau)$ |
| Isochoric heat capacity: $c_\upsilon(T, \rho) = (\partial u/\partial T)_\upsilon$ | $\frac{c_\upsilon(\delta, \tau)}{R} = -\tau^2(\phi^0_{\tau\tau} + \phi^r_{\tau\tau})$ |
| Enthalpy: $h(T, p) = A - T(\partial A/\partial T)_\upsilon - \upsilon(\partial A/\partial \upsilon)_T$ | $\frac{h(\delta, \tau)}{RT} = 1 + \tau(\phi^0_\tau + \phi^r_\tau) + \delta\phi^r_\delta$ |
| Isobaric heat capacity: $c_p(T, p) = (\partial h/\partial T)_p$ | $\frac{c_p(\delta, \tau)}{R} = -\tau^2(\phi^0_{\tau\tau} + \phi^r_{\tau\tau}) + \frac{(1 + \delta\phi^r_\delta - \delta\tau\phi^r_{\delta\tau})^2}{1\|2\delta\phi^r_\delta\|\delta^2\phi^r_{\delta\delta}}$ |

TABLE 1-continued

| relations of thermodynamic properties to the dimensionless Helmholtz function | |
|---|---|
| Property and common thermodynamic definition | Relation to the reduced Helmholtz energy Ø and its derivatives |
| Saturated liquid heat capacity: $c_\sigma(T) = (\partial h/\partial T)_p +$ | $\frac{c_\sigma(\tau)}{R} = -\tau^2(\phi^0_{\tau\tau} + \phi^r_{\tau\tau}) + \frac{1 + \delta\phi^r_\delta - \delta\tau\phi^r_{\delta\tau}}{1 + 2\delta\phi^r_\delta + \delta^2\phi^r_{\delta\delta}}\cdot$ |
| $T(\partial p/\partial T)_\upsilon \cdot (dp_s/dT)/(\partial p/\partial \upsilon)T\|_{\upsilon=\upsilon}$. | $\left[(1 + \delta\phi^r_\delta - \delta\tau\phi^r_{\delta\tau}) - \frac{\rho_c}{R\delta}\frac{dp_s}{dT}\right]$ |
| Speed of sound: $w(T, p) = \sqrt{(\partial p/\partial \rho)_s}$ | $\frac{w^2(\delta, \tau)}{RT} = 1 + 2\delta\phi^r_\delta + \delta^2\phi^r_{\delta\delta} - \frac{(1 + \delta\phi^r_\delta - \delta\tau\phi^r_{\delta\tau})^2}{\tau^2(\phi^0_{\tau\tau} + \phi^r_{\tau\tau})}$ |
| Joule-Thomson coefficient: $\mu(T, p) = (\partial T/\partial p)_h$ | $\mu R\rho = \frac{-(\delta\phi^r_\delta + \delta^2\phi^r_{\delta\delta} + \delta\tau\phi^r_{\delta\tau})}{(1 + \delta\phi^r_\delta - \delta\tau\phi^r_{\delta\tau})^2 - \tau^2(\phi^0_{\tau\tau} + \phi^r_{\tau\tau})(1 + 2\delta\phi^r_\delta + \delta^2\phi^\tau_{\delta\delta})}$ |
| Fugacity: $\ln(\varphi(T, p)) = \int_0^p\left[\frac{\upsilon(T, p)}{RT} - \frac{1}{p}\right]dp_T$ | $\ln \varphi(\delta,\tau) = \phi^r + \delta\phi_\delta{}^r - \ln(1 + \delta\phi_\delta{}^r)$ |

$\phi_\delta = \left[\frac{\partial\phi}{\partial\delta}\right]_\tau$, $\delta_{\delta\delta} = \left[\frac{\partial^2\phi}{\partial\delta^2}\right]_\tau$, $\phi_\tau = \left[\frac{\partial\phi}{\partial\tau}\right]_\delta$, $\phi_{\tau\tau} = \left[\frac{\partial^2\phi}{\partial\tau^2}\right]_\delta$, and $\phi_{\delta\tau} = \left[\frac{\partial^2\phi}{\partial\delta\partial\tau}\right]$.

The part of ideal-gas behavior $Ø^o$ is given as $$Ø^o(\delta, \tau) = \ln(\delta) + a^o_1 + a^o_2\tau + a^o_3\ln(\tau) + \sum_{i=4}^{8} a^o_i\ln[1 - \exp(-\tau\theta^o_i)] \quad (2)$$

Where the coefficients of equation 2 are listed in table 2.

The part of the residual fluid behavior $Ø^r$ is given as $$Ø^r(\delta, \tau) = \sum_{i=4}^{7} n_i\delta^{d_i}\tau^{t_i} + \sum_{i=8}^{34} n_i\delta^{d_i}\tau^{t_i}e^{-\delta^{c_i}} + \sum_{i=35}^{39} n_i\delta^{d_i}\tau^{t_i}e^{-a_i(\delta-\varepsilon_i)^2-\beta_i(\tau-\gamma_i)^2} + \sum_{i=40}^{42} n_i\Delta^{b_i}\delta\, e^{-C_i(\delta-1)^2-D_i(\tau-1)^2} \quad (3)$$

-continued $$\text{With } \Delta = \left\{(1 - \tau) + A_i\left[(\delta - 1)^2\right]^{\frac{1}{2\beta_i}}\right\}^2 + B_i\left[(\delta - 1)^2\right]^{a_i}$$

Where the coefficients of equations 3 are listed in table 3.

TABLE 2

| coefficients for equation 2. | | |
|---|---|---|
| i | $a^o{}_i$ | $\theta^o{}_i$ |
| 1 | 8.37304456 | |
| 2 | −3.70454304 | |
| 3 | 2.50000000 | |
| 4 | 1.99427042 | 3.15163 |
| 5 | 0.62105248 | 6.11190 |
| 6 | 0.41195293 | 6.77708 |
| 7 | 1.04028922 | 11.32384 |
| 8 | 0.08327678 | 27.08792 |

TABLE 3

| coefficients for equation 3. | | | | |
|---|---|---|---|---|
| i | $n_i$ | $d_i$ | $t_i$ | |
| 1 | $0.38856823203161\times10^0$ | 1 | 0.00 | |
| 2 | $0.29385475942740\times10^1$ | 1 | 0.75 | |
| 3 | $-0.55867188534934\times10^1$ | 1 | 1.00 | |
| 4 | $-0.76753199592477\times10^0$ | 1 | 2.00 | |
| 5 | $0.31729005580416\times10^0$ | 2 | 0.75 | |
| 6 | $0.54803315897767\times10^0$ | 2 | 2.00 | |
| 7 | $0.12279411220335\times10^0$ | 3 | 0.75 | |
| i | $n_i$ | $d_i$ | $t_i$ | $c_i$ |
| 8 | $0.21658961543220\times10^{-1}$ | 1 | 1.50 | 1 |
| 9 | $0.15841735199724\times10^{-1}$ | 2 | 1.50 | 1 |
| 10 | $-0.23132705405503\times10^0$ | 4 | 2.50 | 1 |
| 11 | $0.58116916431436\times10^{-1}$ | 5 | 0.00 | 1 |
| 12 | $-0.53369137205382\times10^0$ | 5 | 1.50 | 1 |
| 13 | $0.48946615909422\times10^0$ | 5 | 2.00 | 1 |
| 14 | $-0.24275739843501\times10^{-1}$ | 6 | 0.00 | 1 |
| 15 | $0.62494790501678\times10^{-1}$ | 6 | 1.00 | 1 |
| 16 | $-0.12175860225246\times10^0$ | 6 | 2.00 | 1 |
| 17 | $-0.37055685270086\times10^0$ | 1 | 3.00 | 2 |
| 18 | $-0.16775879700426\times10^{-5}$ | 1 | 6.00 | 2 |

TABLE 3-continued coefficients for equation 3.

| | | | | |
|---|---|---|---|---|
| 19 | $-0.11960736637987\times10^{0}$ | 4 | 3.00 | 2 |
| 20 | $-0.45619362508778\times10^{-1}$ | 4 | 6.00 | 2 |
| 21 | $0.35612789270346\times10^{-1}$ | 4 | 8.00 | 2 |
| 22 | $-0.74427727132052\times10^{-2}$ | 7 | 6.00 | 2 |
| 23 | $-0.17395704902432\times10^{-2}$ | 8 | 0.00 | 2 |
| 24 | $-0.21810121289527\times10^{-1}$ | 2 | 7.00 | 3 |
| 25 | $0.24332166559236\times10^{-1}$ | 3 | 12.00 | 3 |
| 26 | $-0.37440133423463\times10^{-1}$ | 3 | 16.00 | 3 |
| 27 | $0.14338715756878\times10^{0}$ | 5 | 22.00 | 4 |
| 28 | $-0.13491969083286\times10^{0}$ | 5 | 24.00 | 4 |
| 29 | $-0.23151225053480\times10^{-1}$ | 6 | 16.00 | 4 |
| 30 | $0.12363125492901\times10^{-1}$ | 7 | 24.00 | 4 |
| 31 | $0.21058321972940\times10^{-2}$ | 8 | 8.00 | 4 |
| 32 | $-0.33958519026368\times10^{-3}$ | 10 | 2.00 | 4 |
| 33 | $0.55993651771592\times10^{-2}$ | 4 | 28.00 | 5 |
| 34 | $-0.30335118055646\times10^{-2}$ | 8 | 14.00 | 6 |

| i | $n_i$ | $d_i$ | $t_i$ | $\alpha_i$ | $\beta_i$ | $\gamma_i$ | $\sigma_i$ |
|---|---|---|---|---|---|---|---|
| 35 | $-0.21365488688320\times10^{0}$ | 2 | 1.00 | 25 | 325 | 1.16 | 1.00 |
| 36 | $0.26641569149272\times10^{5}$ | 2 | 0.00 | 25 | 300 | 1.19 | 1.00 |
| 37 | $-0.24027212204557\times10^{5}$ | 2 | 1.00 | 25 | 300 | 1.19 | 1.00 |
| 38 | $-0.28341603423999\times10^{3}$ | 3 | 3.00 | 15 | 275 | 1.25 | 1.00 |
| 39 | $0.21247284400179\times10^{3}$ | 3 | 3.00 | 20 | 275 | 1.22 | 1.00 |

| i | $n_i$ | $\alpha_i$ | $b_i$ | $\beta_i$ | $A_i$ | $B_i$ | $C_i$ | $D_i$ |
|---|---|---|---|---|---|---|---|---|
| 40 | $-0.66642276540753\times10^{0}$ | 3.500 | 0.875 | 0.300 | 0.700 | 0.3 | 10.0 | 275 |
| 41 | $0.72608632349897\times10^{0}$ | 3.500 | 0.925 | 0.300 | 0.700 | 0.3 | 10.0 | 275 |
| 42 | $0.55068668612842\times10^{-1}$ | 3.000 | 0.875 | 0.300 | 0.700 | 1.0 | 12.5 | 275 |

The melting pressure is calculated as:

$$\frac{p_m}{p_t} = 1 + a_1\left(\frac{T}{T_t} - 1\right) + a_2\left(\frac{T}{T_t} - 1\right)^2 \tag{4}$$

Where $p_m$ is the melting pressure $p_t$ is the triple point pressure, =0.51795 MPa $T_t$ is the triple point temperature, =216.592 K $a_1$ is coefficient, =1955.5390

$a_2$ is coefficient, =2055.4593

Sublimation pressure is calculated as:

$$\ln\left(\frac{p_{sub}}{p_t}\right) = \frac{T}{T_t}\left\{a_1\left(1-\frac{T}{T_t}\right)+a_2\left(1-\frac{T}{T_t}\right)^{1.9}+a_3\left(1-\frac{T}{T_t}\right)^{2.9}\right\} \tag{5}$$

Where $p_{msub}$ is the sublimation pressure $p_t$ is the triple point pressure, =0.51795 MPa $T_t$ is the triple point temperature, =216.592 K $a_1$ is coefficient, =−14.740846

$a_2$ is coefficient, =2.4327015

$a_3$ is coefficient, =−5.3061778

Vapor pressure is calculated as $$\ln\left(\frac{p_s}{p_c}\right) = \frac{T_c}{T}\left[\sum_{i=1}^{4} a_i\left(1 - \frac{T}{T_c}\right)^{t_i}\right] \tag{6}$$

Where $p_s$ is the vapor pressure $p_c$ is the critical point pressure, =7.3773 MPa $T_c$ is the critical point temperature, =304.1282 K $a_1$ is coefficient, =−7.0602087

$a_2$ is coefficient, =1.9391218

$a_3$ is coefficient, =−1.6463597

$a_4$ is coefficient, =−3.2995634

$t_1$ is coefficient, =1.0

$t_2$ is coefficient, =1.5

$t_3$ is coefficient, =2.0

$t_4$ is coefficient, =4.0

Saturated liquid density is calculated as $$\ln\left(\frac{\rho'}{\rho_c}\right) = \sum_{i=1}^{4} a_i\left(1 - \frac{T}{T_c}\right)^{t_i} \tag{7}$$

Where

ρ' is the saturated liquid density $\rho_c$ is the critical point density, =467.6 kg/m$^3$ $T_c$ is the critical point temperature, =304.1282 K $a_1$ is coefficient, =1.9245108

$a_2$ is coefficient, =−0.62385555

$a_3$ is coefficient, =−0.32731127

$a_4$ is coefficient, =0.39245142

$t_1$ is coefficient, =0.34

$t_2$ is coefficient, =0.5

$t_3$ is coefficient, =10/6

$t_4$ is coefficient, =11/6

Saturated vapor density is calculated as $$\ln\left(\frac{\rho''}{\rho_c}\right) = \sum_{i=1}^{5} a_i\left(1 - \frac{T}{T_c}\right)^{t_i} \tag{8}$$

Where

ρ" is the saturated vapor density $\rho_c$ is the critical point density, =467.6 kg/m$^3$ $T_c$ is the critical point temperature, =304.1282 K $a_1$ is coefficient, =−1.7074879

$a_2$ is coefficient, =−0.82274670
$a_3$ is coefficient, =−4.6008549
$a_4$ is coefficient, =−10.111178
$a_5$ is coefficient, =−29.742252
$t_1$ is coefficient, =0.340
$t_2$ is coefficient, =0.5
$t_3$ is coefficient, =1
$t_4$ is coefficient, =7/3
$t_5$ is coefficient, =14/3
The triple point temperature and pressure are:

$$T_t = (216.592 \pm 0.003)\,\mathrm{K} \tag{9}$$

$$p_t = (0.51795 \pm 0.00010)\,\mathrm{MPa} \tag{10}$$

The density of the saturated liquid and the saturated vapor at the triple point are calculated from the above equations:

$$\rho_t' = (1178.53 \pm 0.18)\ \mathrm{kg/m^3} \tag{11}$$

$$\rho_t'' = (13.7614 \pm 0.0034)\ \mathrm{kg/m^3} \tag{12}$$

The critical point temperature and pressure are:

$$T_c = (304.1282 \pm 0.015)\ \mathrm{K} \tag{13}$$

$$p_c = (7.3773 \pm 0.0030)\ \mathrm{MPa} \tag{14}$$

The density at critical point is:

$$\rho_t' = (467.6 \pm 0.6)\ \mathrm{kg/m^3}$$

Figure 2:
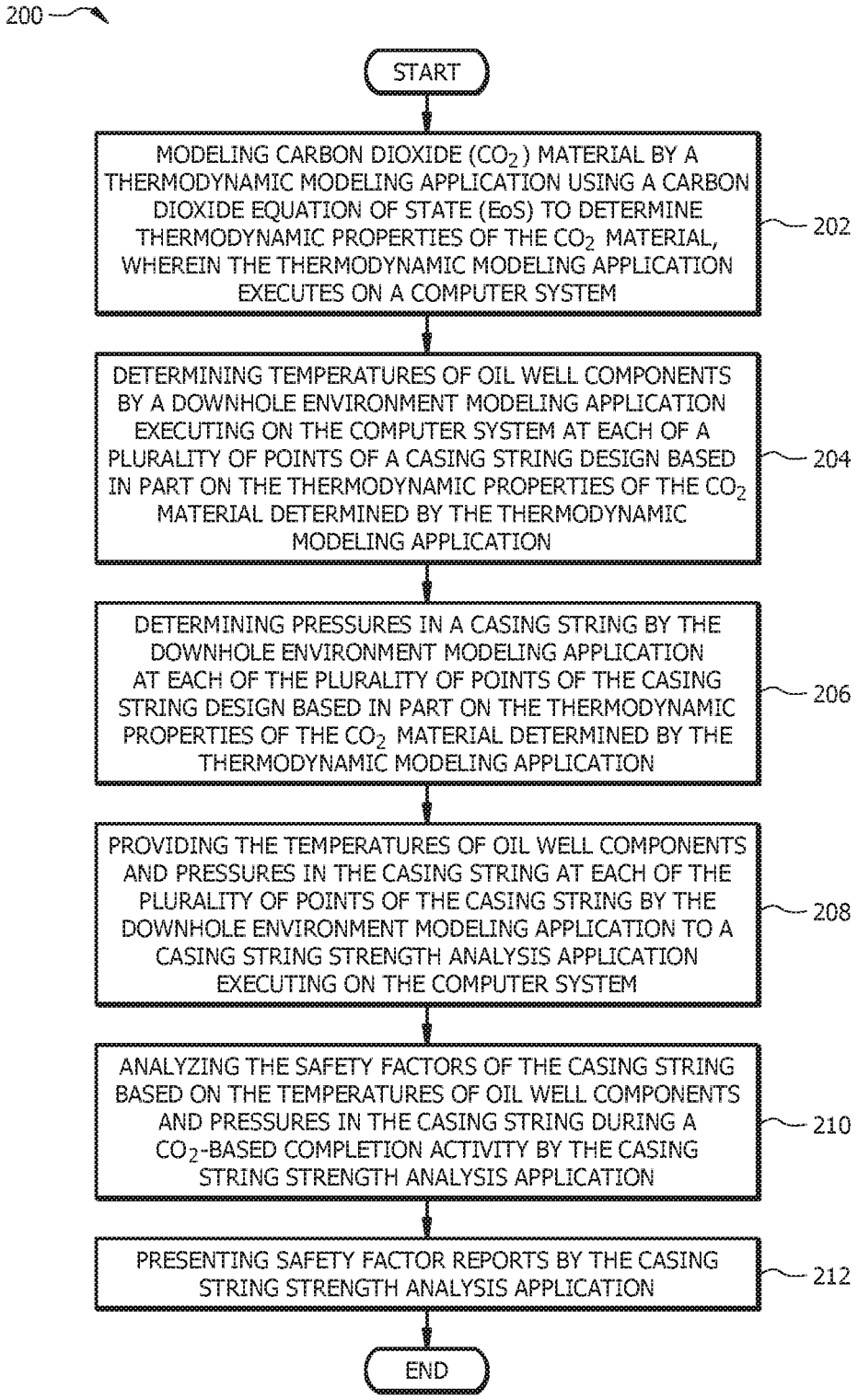
FIG. 2 is a flow chart of a method according to embodiments of the disclosure.

Turning now to FIG. 2, a method 200 is described. In embodiments, the method 200 includes a method of designing a casing string for an oil well. It is understood that the term oil well is used generally and can refer to any hole in the ground. The oil well may, during a production phase of its lifecycle, produce crude oil. The oil well may produce natural gas. The oil well may produce crude oil and natural gas in some combination or mixture. The oil well may produce hydrocarbons—either crude oil or natural gas or both—in combination with water. In embodiments, the method 200 is a method of designing a casing string for a gas well. In embodiments, the method 200 is a method of designing a casing string for an oil and gas well. In embodiments, the method 200 is a method of designing a casing string for a geothermal well.

At block 202, the method 200 includes modeling carbon dioxide ($CO_2$) material by a thermodynamic modeling application using a carbon dioxide equation of state (EoS) to determine thermodynamic properties of the $CO_2$ material, wherein the thermodynamic modeling application executes on a computer system. In embodiments, the $CO_2$ EoS may be a Span-Wagner $CO_2$ EoS. In embodiments, the $CO_2$ EoS may be derived from the Span-Wagner $CO_2$ EoS. In embodiments, the $CO_2$ EoS may be a different $CO_2$ EoS. The processing of block 202 may be based in part on a specification of the wellbore and/or the casing string. The modeling of $CO_2$ may be related to a $CO_2$ well operation, for example a $CO_2$ injection operation or a $CO_2$ circulation operation. The modeling of $CO_2$ may take into account phase changes at different points along the wellbore and/or along the casing string. In embodiments, the modeling of the $CO_2$ by the thermodynamic modeling application may employ a first heat transfer equation associated with a $CO_2$ gas phase to analyze $CO_2$ where it has been determined to be in gas phase and may employ a second heat transfer equation associated with a $CO_2$ liquid phase to analyze $CO_2$ where it has been determined to be in liquid phase.

The determination of thermodynamic properties by the thermodynamic modeling application takes into account heat energy transfers which take place pursuant to phase changes of the $CO_2$. For example, while the temperature of the $CO_2$ at the moment it changes from a liquid to a gas phase may remain constant, heat energy may nevertheless be transferred from the surrounding system (e.g., wellbore and/or casing) to the $CO_2$ to drive the phase change.

At block 204, the method 200 includes determining temperatures of oil well components by a downhole environment modeling application executing on the computer system at each of a plurality of points of a casing string design based in part on the thermodynamic properties of the $CO_2$ material determined by the thermodynamic modeling application. In embodiments, the downhole environment modeling application may employ a first heat transfer equation associated with a $CO_2$ gas phase, at least in part, to determine temperature where the $CO_2$ has been determined to be in gas phase and may employ a second heat transfer equation associated with a $CO_2$ liquid phase, at least in part, to determine temperature where the $CO_2$ has been determined to be in liquid phase. At block 206, the method 200 includes determining pressures in a casing string by the downhole environment modeling application at each of the plurality of points of the casing string design based in part on the thermodynamic properties of the $CO_2$ material determined by the thermodynamic modeling application. In embodiments, temperature and pressure downhole environment parameters may be obtained from a thermal flow simulation for each of the plurality of calculation points along the casing string in the wellbore. For further details about estimating downhole environment parameters such as temperature and pressure, see U.S. patent application Ser. No. 15/359,397, filed Nov. 22, 2016, entitled "Vector-ratio Safety Factors for Wellbore Tubular Design," by Zhengchun Liu, et al, which is incorporated herein by reference in its entirety.

At block 208, the method 200 includes providing the temperatures of oil well components and pressures in the casing string at each of the plurality of points of the casing string by the downhole environment modeling application to a casing string strength analysis application executing on the computer system. At block 210, the method 200 includes analyzing the safety factors of the casing string based on the temperatures of oil well components and pressures in the casing string during a $CO_2$-based completion activity by the casing string strength analysis application. At block 212, the method 200 includes presenting safety factor reports by the casing string strength analysis application. The processing of method 200 may be performed by the casing design tool 108. The processing of method 200 may be reiterated multiple times, where a casing designer or engineer varies some parameter of the casing string design in each iteration cycle to successively optimize the casing string design. At the completion of method 200 or several iterations of method 200, a satisfactory final casing string design may be established, and this final casing string design may be employed to buy materials to case the subject wellbore and to build the casing string. It is understood that the casing string may be built in a wellbore in different time phases. For example, a surface casing string may be installed and cemented in the wellbore after the wellbore has been partially drilled but not drilled to target depth. While the actual deployment of the casing string may extend over a period of time, the casing string design may be completed at the outset, before any portion of the casing is deployed. In embodiments, the thermodynamic modeling application, the downhole environment modeling application, and the casing string strength analysis application are integrated with each other.

Figure 3:
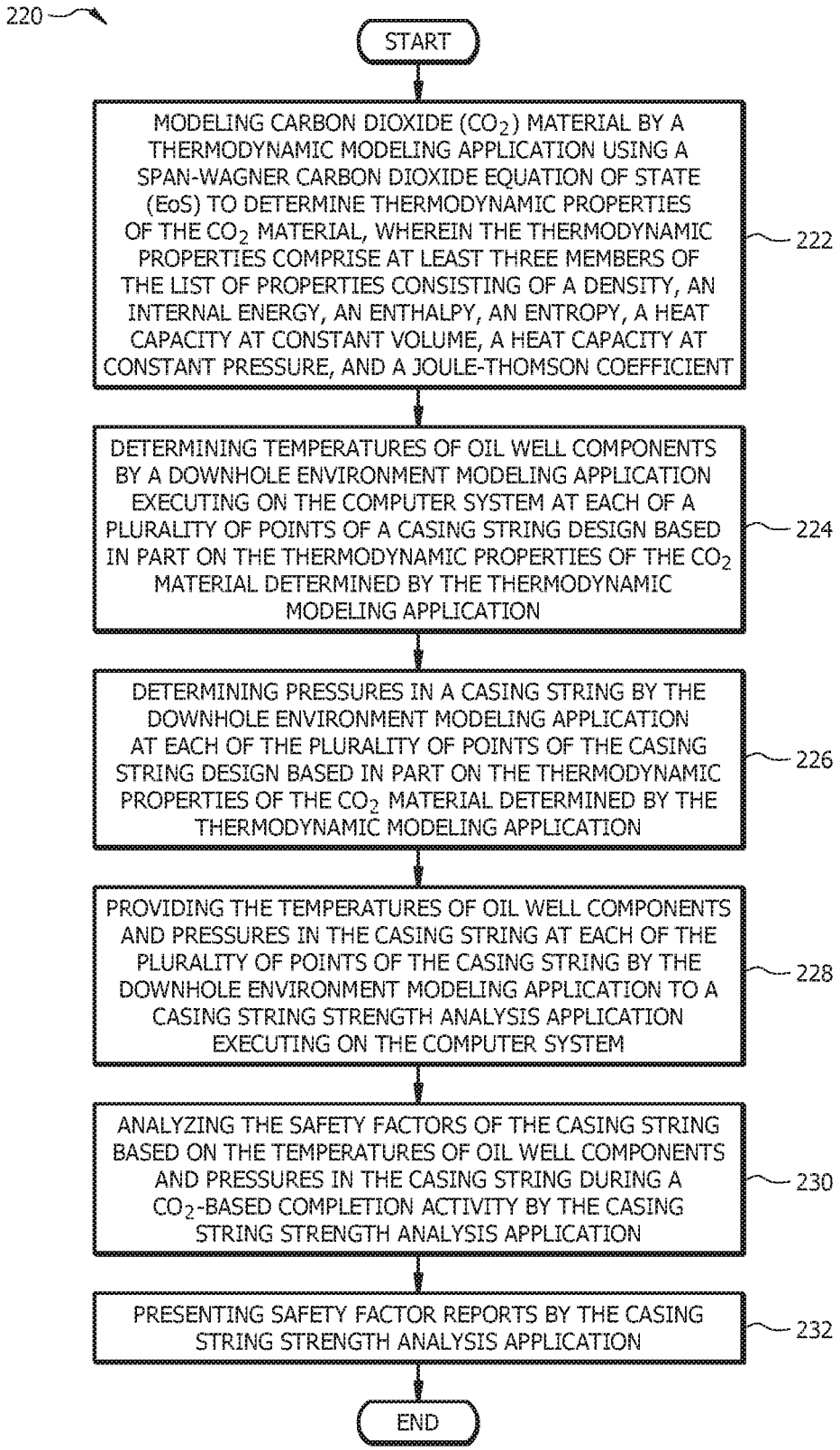
FIG. 3 is a flow chart of another method according to embodiments of the disclosure.

Turning now to FIG. 3, a method 220 is described. In embodiments, the method 220 is a method of designing a casing string for an oil well. In embodiments, the method 220 is a method of designing a casing string for a gas well. In embodiments, the method 220 is a method of designing a casing string for an oil and gas well. In embodiments, the method 220 is a method of designing a casing string for a geothermal well.

At block 222, the method 200 includes modeling carbon dioxide ($CO_2$) material by a thermodynamic modeling application using a Span-Wagner carbon dioxide equation of state (EoS) to determine thermodynamic properties of the $CO_2$ material, wherein the thermodynamic properties include at least three members of the list of properties consisting of a density, an internal energy, an enthalpy, an entropy, a heat capacity at constant volume, a heat capacity at constant pressure, and a Joule-Thomson coefficient, wherein the thermodynamic modeling application executes on a computer system. The modeling of $CO_2$ may take into account phase changes at different points along the wellbore and/or along the casing string. In embodiments, the modeling of the $CO_2$ by the thermodynamic modeling application may employ a first heat transfer equation associated with a $CO_2$ gas phase to analyze $CO_2$ where it has been determined to be in gas phase and may employ a second heat transfer equation associated with a $CO_2$ liquid phase to analyze $CO_2$ where it has been determined to be in liquid phase.

The determination of thermodynamic properties by the thermodynamic modeling application takes into account heat energy transfers which take place pursuant to phase changes of the $CO_2$. For example, while the temperature of the $CO_2$ at the moment it changes from a liquid to a gas phase may remain constant, heat energy may nevertheless be transferred from the surrounding system (e.g., wellbore and/or casing) to the $CO_2$ to drive the phase change.

At block 224, the method 220 includes determining temperatures of oil well components by a downhole environment modeling application executing on the computer system at each of a plurality of points of a casing string design based in part on the thermodynamic properties of the $CO_2$ material determined by the thermodynamic modeling application. In embodiments, the downhole environment modeling application may employ a first heat transfer equation associated with a $CO_2$ gas phase, at least in part, to determine temperature where the $CO_2$ has been determined to be in gas phase and may employ a second heat transfer equation associated with a $CO_2$ liquid phase, at least in part, to determine temperature where the $CO_2$ has been determined to be in liquid phase. At block 226, the method 220 includes determining pressures in a casing string by the downhole environment modeling application at each of the plurality of points of the casing string design based in part on the thermodynamic properties of the $CO_2$ material determined by the thermodynamic modeling application. In embodiments, temperature and pressure downhole environment parameters may be obtained from a thermal flow simulation for each of the plurality of calculation points along the casing string in the wellbore.

At block 228, the method 220 includes providing the temperatures of oil well components and pressures in the casing string at each of the plurality of points of the casing string by the downhole environment modeling application to a casing string strength analysis application executing on the computer system. At block 230, the method 220 includes analyzing the safety factors of the casing string based on the temperatures of oil well components and pressures in the casing string during a $CO_2$-based completion activity by the casing string strength analysis application. At block 232, the method includes presenting safety factor reports by the casing string strength analysis application. The processing of method 220 may be performed by the casing design tool 108. The processing of method 220 may be reiterated multiple times, where a casing designer or engineer varies some parameter of the casing string design in each iteration cycle to successively optimize the casing string design. At the completion of method 220 or several iterations of method 220, a satisfactory final casing string design may be established, and this final casing string design may be employed to buy materials to case the subject wellbore and to build the casing string. In embodiments, the thermodynamic modeling application, the downhole environment modeling application, and the casing string strength analysis application are integrated with each other.

Figure 4:
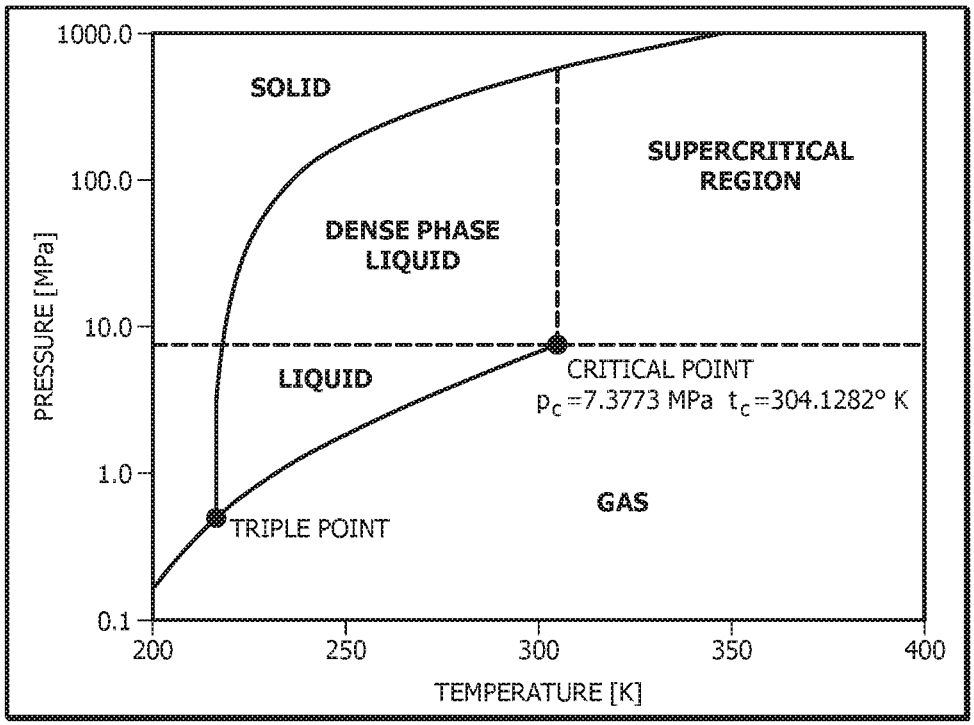
FIG. 4 is a phase diagram of $CO_2$ developed to a $CO_2$ equation of state (EoS) according to embodiments of the disclosure.

Turning now to FIG. 4, an exemplary phase diagram of $CO_2$ is shown. The thermodynamic modeling application 110 models $CO_2$ in the wellbore with an EoS to more accurately estimate, determine, and/or calculate thermodynamic properties of $CO_2$ that may be expected to prevail downhole in a wellbore during $CO_2$ operations such as $CO_2$ injection and/or $CO_2$ circulation. The more accurately estimated, determined, and/or calculated thermodynamic properties of $CO_2$ downhole in turn promotes the more accurate estimation, determination, and or calculation of temperatures and pressures in the wellbore and in a casing string. The properties of the pure $CO_2$ are calculated based on an EoS modeling method with triple point temperature to 1100K and pressure up to 800 MPa, covering a wide range of the phase diagram of $CO_2$ (FIG. 4). The EoS modeling calculates the properties of the pure $CO_2$, density, internal, enthalpy, entrop, heat capacity at constant volume (Cv), and heat capacity at constant pressure (Cp), Joule-Thomson Coefficient, and speed of sound, as well as the phase change boundary, at different phase state.

This system (e.g., the downhole environment modeling application 112) firstly calculates the temperature profiles of the well components (tubings, casing, and fluids in annulus, and cements in annulus) and pressure profiles of the annulus fluid of the operation with $CO_2$ where the $CO_2$ is modeled with EoS method. The operation is an injection operation, but could also be another operation such as but not limited to circulation.

Figure 5:
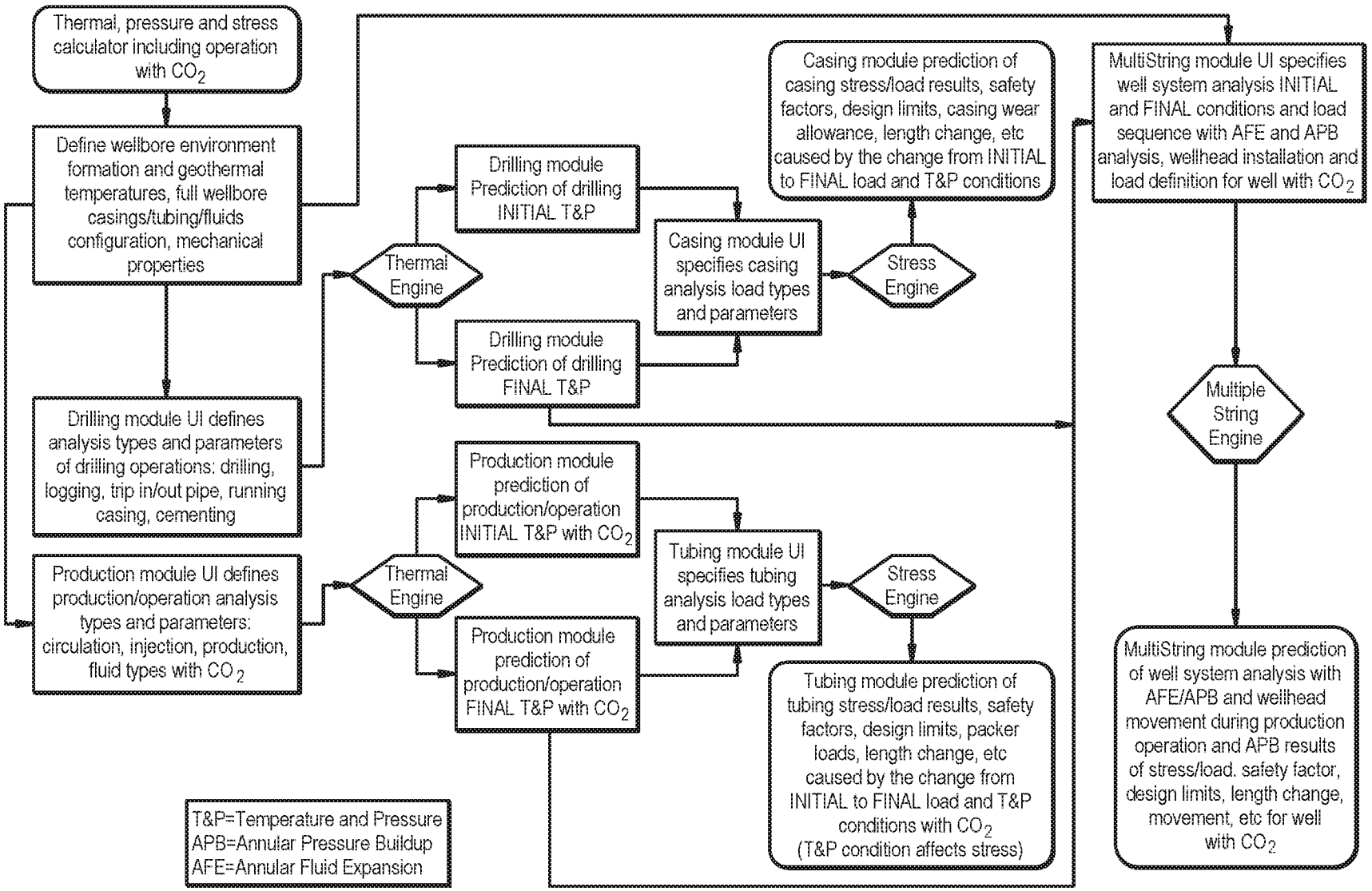
FIG. 5 is the workflow diagram according to embodiments of the disclosure.

The temperature and pressure profiles are integratedly loaded to the casing and tubing modules (e.g., the casing strength modeling application 114) for stress analysis, where the temperature effect on the material is considered, for each single string. The temperature and pressure profile are also integratedly loaded to a Multi-String module for stress analysis for the whole wellbore tubular system, where the temperature effect on the trapped annulus fluid expansion (AFE) and trapped annulus pressure buildup (APB) are considered. The stress analysis provides safety factors calculation based on various criteria, such as axial safety factor, collapse safety factor, burst safety, etc. for safety evaluation of the string, which is desirable for well tubular design FIG. 5 is an exemplary workflow for the integrated calculation steps performed using the system 100 described in this disclosure. The system first defines data (e.g., specification of wellbore and casing string) for the well and its environment data such as geothermal gradient, fracture gradient, pore pressure gradient, formation types and properties, the well trajectory (well path), the tubing and casing tubular strings size and properties (materials and mechanical properties), tubular strings installation hanger and shoe depth as well as their hole size. Then the UI system sends the related data from above to the thermal engine to do the calculation to obtain the temperature and pressure profiles of operation with $CO_2$ modeled with EoS. Once the temperature and pressure profiles are calculated, then they are integratedly loaded into the stress analysis engine to perform the stress analysis with the effect from the complex temperature profile at different stage of the well life cycle. There are multiple stress-analysis load types for evaluating the collapse, burst, axial safety of the string.

After the tubing and casing tubular string are installed in a well, it is needed to consider its behavior in an environment of the well system. In a well system, the fluid is trapped in the annulus, and once temperature changes, the fluid expands or shrinks (which is called trapped annular fluid expansion (AFE) or trapped annular pressure buildup (APB)), this will induce additional pressure on the strings and results in additional stress on them, so that impact their safety and well integrity. With this consideration, the temperature and pressure profiles are also integratedly loaded in to the multi-string engine to perform the stress analysis under such condition within a well system from initial conditions to final conditions at different well lifecycle.

Figure 6:
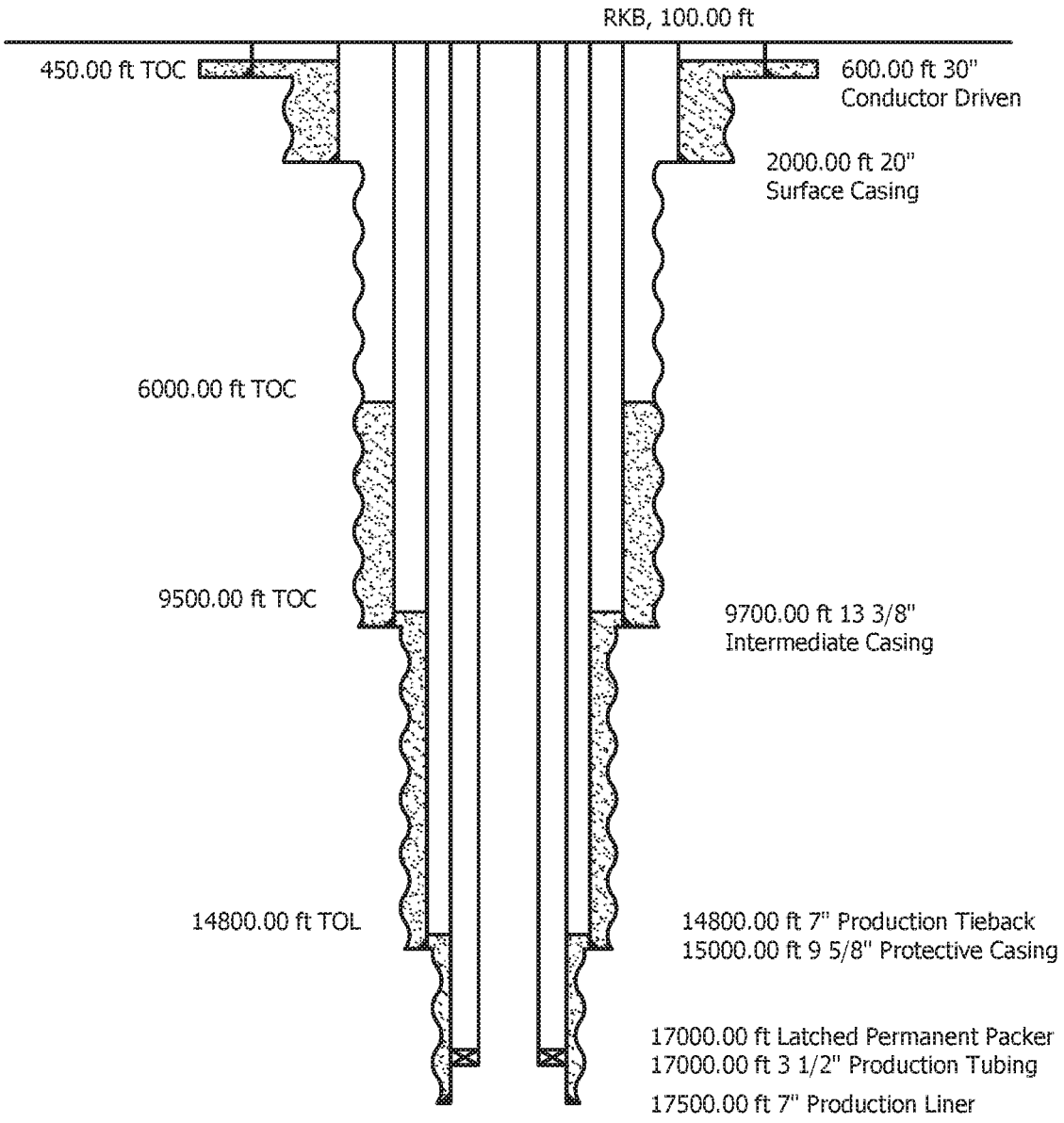
FIG. 6 is an illustration of an exemplary single completion well according to embodiments of the disclosure.
Figure 7:
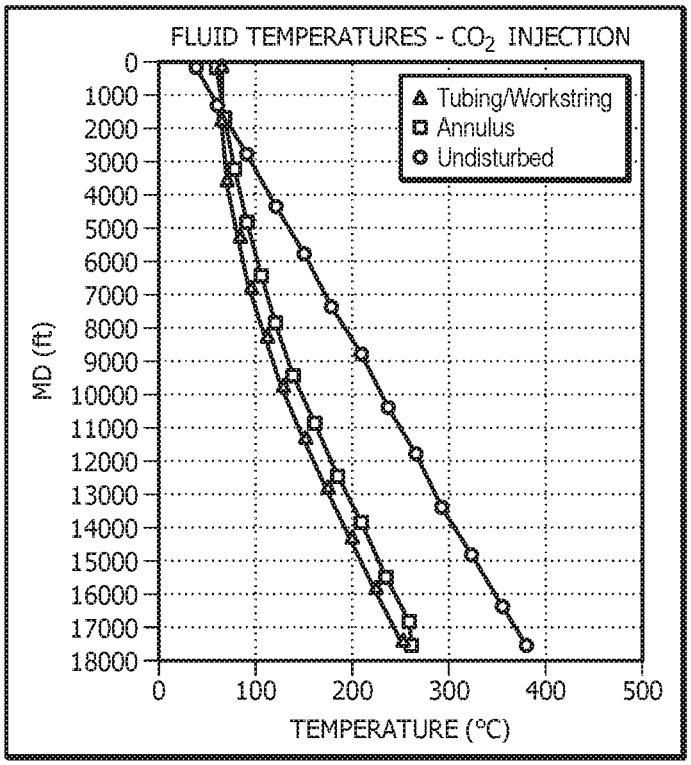
FIG. 7 is an exemplary temperature graph associated with a wellbore $CO_2$ injection operation according to embodiments of the disclosure.
Figure 8:
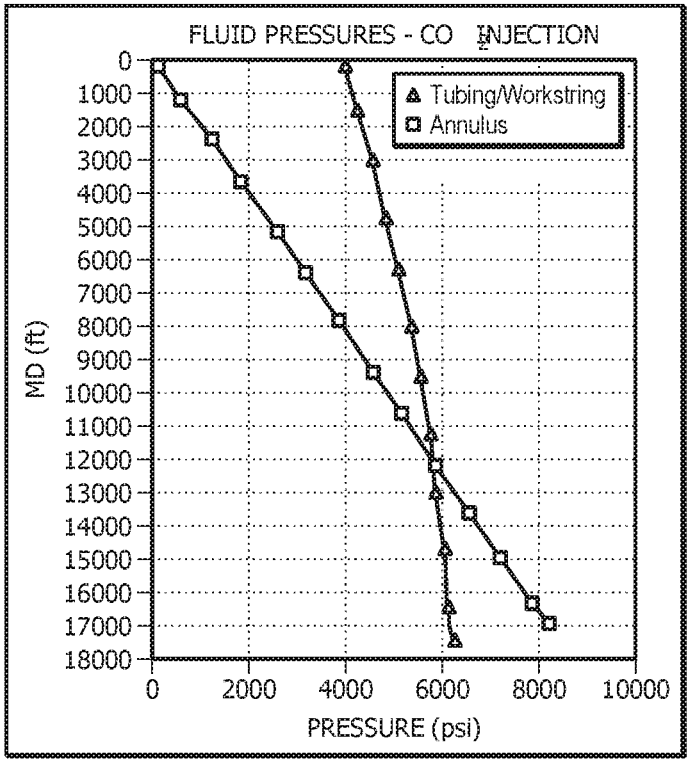
FIG. 8 is an exemplary pressure graph associated with a wellbore $CO_2$ injection operation according to embodiments of the disclosure.

An exemplary single completion and/or casing string is illustrated in FIG. 6. FIG. 7 and FIG. 8 show a typical temperature profile and pressure profile, respectively, for a single completion for $CO_2$ injection where the inlet phase is at liquid phase. The temperature profile (FIG. 7) may result in part of the string is shrinking and part is expanding, or multiple sections of the string is shrinking and/or expanding and induce additional stress on the string depending on the operation initial conditions and final conditions.

Figure 9:
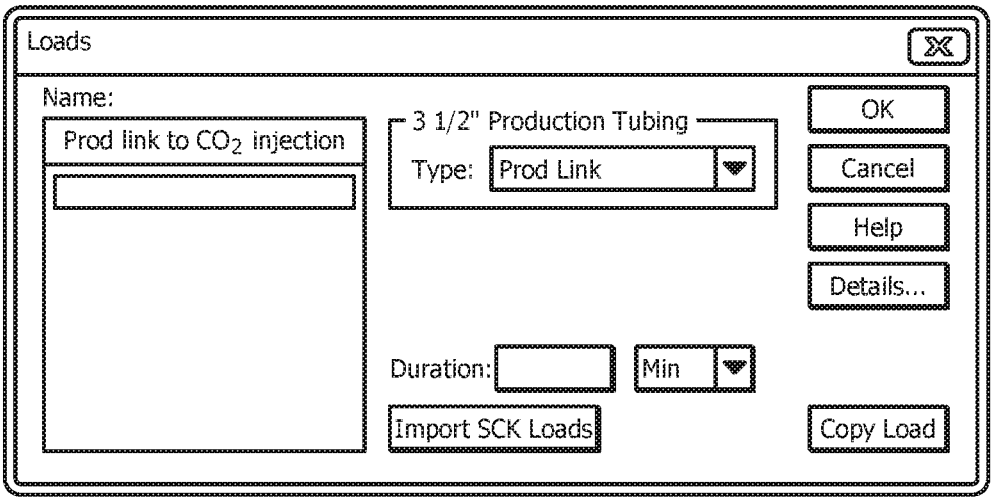
FIG. 9 is an illustration of an exemplary user interface screen according to embodiments of the disclosure.
Figure 10:
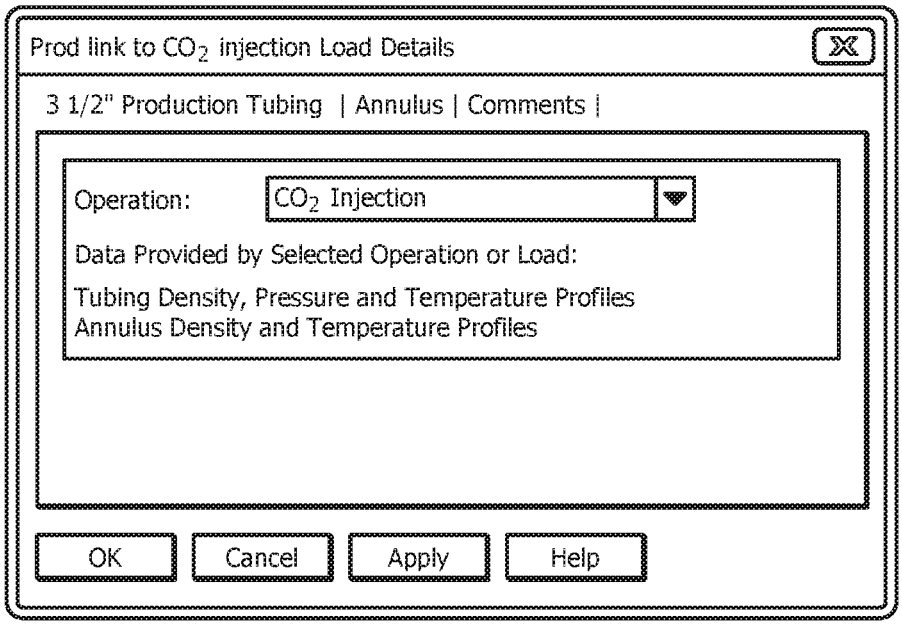
FIG. 10 is an illustration of another exemplary user interface screen according to embodiments of the disclosure.

The temperature profile is integratedly loaded to do the stress analysis, see FIGS. 9 and 10 that depict exemplary user interface screens that may be presented to casing designers on the work station 134.

Figure 11:
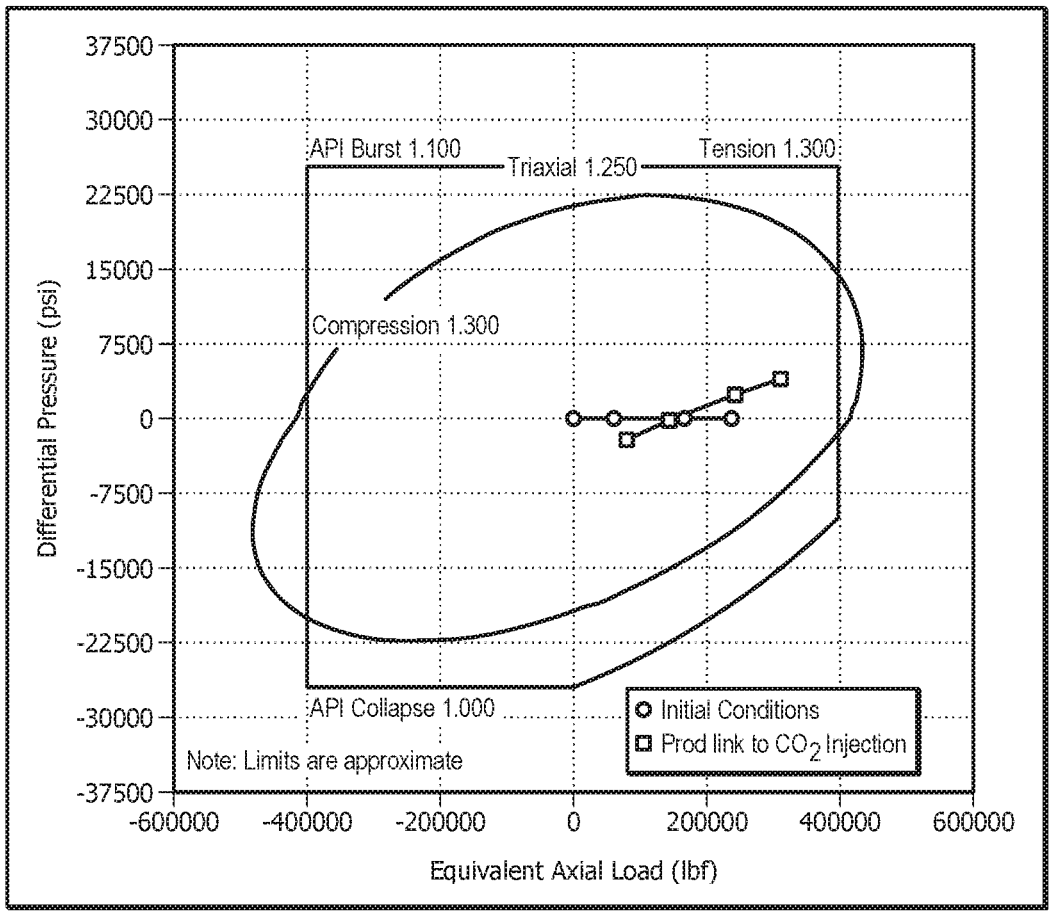
FIG. 11 is an illustration of an exemplary design limit envelope plot according to embodiments of the disclosure.

The design limit plot is shown in FIG. 11. This design limit plot is a straightforward overview to indicate to a designer (e.g., using the workstation 134) whether the string (e.g., the tubing string) is safe or not by checking whether the loads are in the safety envelops. Only all the points being in the envelop means load is safe at all the depths, where if there is any point out of the envelope then some redesign work is desired to ensure it is safe everywhere. The process of designing, modeling, inspecting results may be performed iteratively to converge on an optimal tubing design, for example a casing string design.

Figure 12:
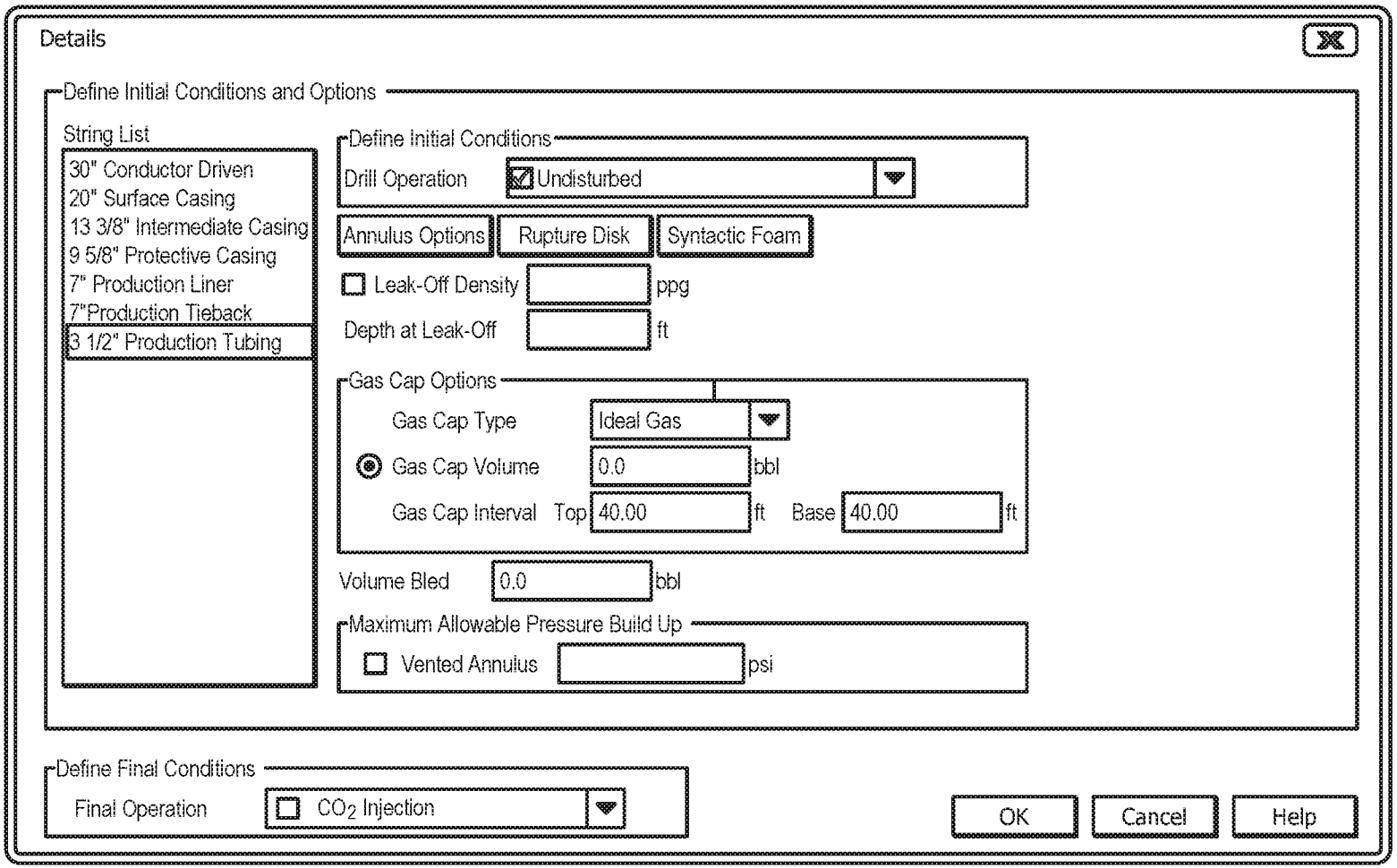
FIG. 12 is an illustration of yet another exemplary user interface screen according to embodiments of the disclosure.
Figure 14:
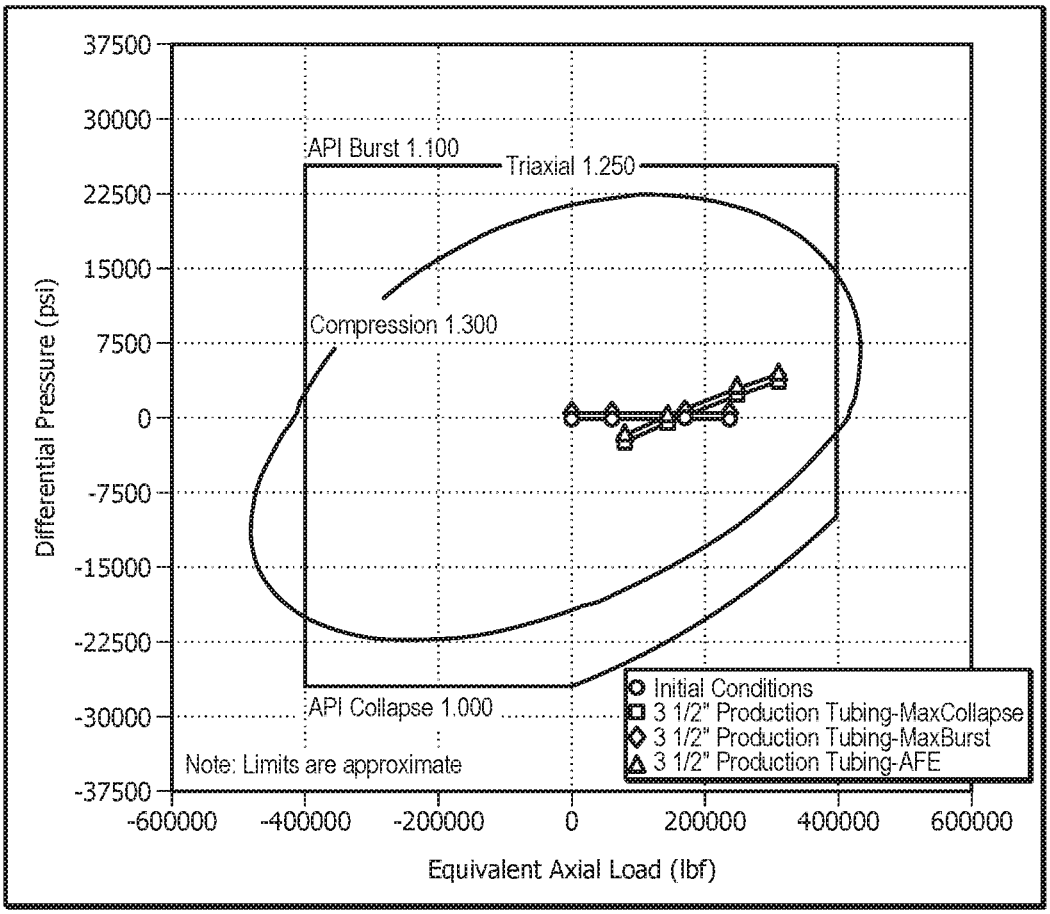
FIG. 14 is an illustration of another exemplary design limit envelope plot according to embodiments of the disclosure.

The temperature profile of such a $CO_2$ injection (could be other operation types too, such as circulation) could then be integratedly loaded to the multistring module for tubular string stress analysis in a well system (FIG. 12). The AFE (APB) of the well system is calculated from the initial conditions to the final conditions due to the temperature effect (FIG. 13). The APB effect is applied to the internal or external pressure profile of a string to do further stress analysis on each string based on the worst-case criteria—max burst load, max collapse load, and load with APB applied at both side of the string. The APB here being negative value is because that the $CO_2$ injection has cooling effect on the well, as indicated from the above well temperature profiles. The worst-case design results are shown in FIG. 14

Figure 15:
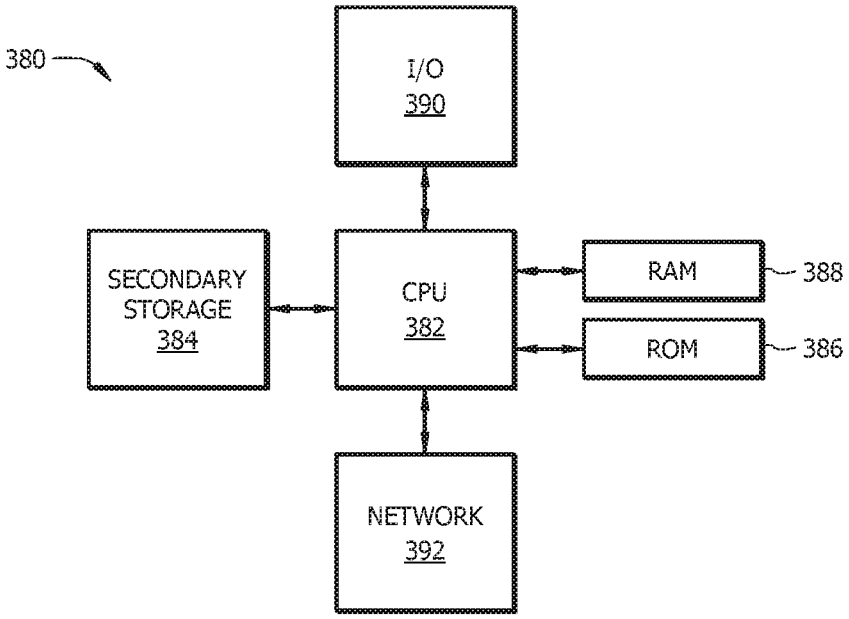
FIG. 15 is a block diagram of a computer system according to embodiments of the disclosure.

FIG. 15 illustrates a computer system 380 suitable for implementing one or more embodiments disclosed herein. The computer system 380 includes a processor 382 (which may be referred to as a central processor unit or CPU) that is in communication with memory devices including secondary storage 384, read only memory (ROM) 386, random access memory (RAM) 388, input/output (I/O) devices 390, and network connectivity devices 392. The processor 382 may be implemented as one or more CPU chips.

It is understood that by programming and/or loading executable instructions onto the computer system 380, at least one of the CPU 382, the RAM 388, and the ROM 386 are changed, transforming the computer system 380 in part into a particular machine or apparatus having the novel functionality taught by the present disclosure. It is fundamental to the electrical engineering and software engineering arts that functionality that can be implemented by loading executable software into a computer can be converted to a hardware implementation by well-known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (ASIC), because for large production runs the hardware implementation may be less expensive than the software implementation. Often a design may be developed and tested in a software form and later transformed, by well-known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

Additionally, after the system 380 is turned on or booted, the CPU 382 may execute a computer program or application. For example, the CPU 382 may execute software or firmware stored in the ROM 386 or stored in the RAM 388. In some cases, on boot and/or when the application is initiated, the CPU 382 may copy the application or portions of the application from the secondary storage 384 to the RAM 388 or to memory space within the CPU 382 itself, and the CPU 382 may then execute instructions that the application is comprised of. In some cases, the CPU 382 may copy the application or portions of the application from memory accessed via the network connectivity devices 392 or via the I/O devices 390 to the RAM 388 or to memory space within the CPU 382, and the CPU 382 may then execute instructions that the application is comprised of During execution, an application may load instructions into the CPU 382, for example load some of the instructions of the application into a cache of the CPU 382. In some contexts, an application that is executed may be said to configure the CPU 382 to do something, e.g., to configure the CPU 382 to perform the function or functions promoted by the subject application. When the CPU 382 is configured in this way by the application, the CPU 382 becomes a specific purpose computer or a specific purpose machine.

The secondary storage 384 is typically comprised of one or more disk drives or tape drives and is used for non-volatile storage of data and as an over-flow data storage device if RAM 388 is not large enough to hold all working data. Secondary storage 384 may be used to store programs which are loaded into RAM 388 when such programs are selected for execution. The ROM 386 is used to store instructions and perhaps data which are read during program execution. ROM 386 is a non-volatile memory device which typically has a small memory capacity relative to the larger memory capacity of secondary storage 384. The RAM 388 is used to store volatile data and perhaps to store instructions. Access to both ROM 386 and RAM 388 is typically faster than to secondary storage 384. The secondary storage 384, the RAM 388, and/or the ROM 386 may be referred to in some contexts as computer readable storage media and/or non-transitory computer readable media.

I/O devices 390 may include printers, video monitors, liquid crystal displays (LCDs), touch screen displays, keyboards, keypads, switches, dials, mice, track balls, voice recognizers, card readers, paper tape readers, or other well-known input devices.

The network connectivity devices 392 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards, and/or other well-known network devices. The network connectivity devices 392 may provide wired communication links and/or wireless communication links (e.g., a first network connectivity device 392 may provide a wired communication link and a second network connectivity device 392 may provide a wireless communication link). Wired communication links may be provided in accordance with Ethernet (IEEE 802.3), Internet protocol (IP), time division multiplex (TDM), data over cable service interface specification (DOCSIS), wave division multiplexing (WDM), and/or the like. In an embodiment, the radio transceiver cards may provide wireless communication links using protocols such as code division multiple access (CDMA), global system for mobile communications (GSM), long-term evolution (LTE), WiFi (IEEE 802.11), Bluetooth, Zigbee, narrowband Internet of things (NB IoT), near field communications (NFC), radio frequency identity (RFID). The radio transceiver cards may promote radio communications using 5G, 5G New Radio, or 5G LTE radio communication protocols. These network connectivity devices 392 may enable the processor 382 to communicate with the Internet or one or more intranets. With such a network connection, it is contemplated that the processor 382 might receive information from the network, or might output information to the network in the course of performing the above-described method steps. Such information, which is often represented as a sequence of instructions to be executed using processor 382, may be received from and outputted to the network, for example, in the form of a computer data signal embodied in a carrier wave.

Such information, which may include data or instructions to be executed using processor 382 for example, may be received from and outputted to the network, for example, in the form of a computer data baseband signal or signal embodied in a carrier wave. The baseband signal or signal embedded in the carrier wave, or other types of signals currently used or hereafter developed, may be generated according to several methods well-known to one skilled in the art. The baseband signal and/or signal embedded in the carrier wave may be referred to in some contexts as a transitory signal.

The processor 382 executes instructions, codes, computer programs, scripts which it accesses from hard disk, floppy disk, optical disk (these various disk based systems may all be considered secondary storage 384), flash drive, ROM 386, RAM 388, or the network connectivity devices 392. While only one processor 382 is shown, multiple processors may be present. Thus, while instructions may be discussed as executed by a processor, the instructions may be executed simultaneously, serially, or otherwise executed by one or multiple processors. Instructions, codes, computer programs, scripts, and/or data that may be accessed from the secondary storage 384, for example, hard drives, floppy disks, optical disks, and/or other device, the ROM 386, and/or the RAM 388 may be referred to in some contexts as non-transitory instructions and/or non-transitory information.

In an embodiment, the computer system 380 may include two or more computers in communication with each other that collaborate to perform a task. For example, but not by way of limitation, an application may be partitioned in such a way as to permit concurrent and/or parallel processing of the instructions of the application. Alternatively, the data processed by the application may be partitioned in such a way as to permit concurrent and/or parallel processing of different portions of a data set by the two or more computers. In an embodiment, virtualization software may be employed by the computer system 380 to provide the functionality of a number of servers that is not directly bound to the number of computers in the computer system 380. For example, virtualization software may provide twenty virtual servers on four physical computers. In an embodiment, the functionality disclosed above may be provided by executing the application and/or applications in a cloud computing environment. Cloud computing may include providing computing services via a network connection using dynamically scalable computing resources. Cloud computing may be supported, at least in part, by virtualization software. A cloud computing environment may be established by an enterprise and/or may be hired on an as-needed basis from a third party provider. Some cloud computing environments may include cloud computing resources owned and operated by the enterprise as well as cloud computing resources hired and/or leased from a third party provider.

In an embodiment, some or all of the functionality disclosed above may be provided as a computer program product. The computer program product may include one or more computer readable storage medium having computer usable program code embodied therein to implement the functionality disclosed above. The computer program product may include data structures, executable instructions, and other computer usable program code. The computer program product may be embodied in removable computer storage media and/or non-removable computer storage media. The removable computer readable storage medium may include, without limitation, a paper tape, a magnetic tape, magnetic disk, an optical disk, a solid state memory chip, for example analog magnetic tape, compact disk read only memory (CD-ROM) disks, floppy disks, jump drives, digital cards, multimedia cards, and others. The computer program product may be suitable for loading, by the computer system 380, at least portions of the contents of the computer program product to the secondary storage 384, to the ROM 386, to the RAM 388, and/or to other non-volatile memory and volatile memory of the computer system 380. The processor 382 may process the executable instructions and/or data structures in part by directly accessing the computer program product, for example by reading from a CD-ROM disk inserted into a disk drive peripheral of the computer system 380. Alternatively, the processor 382 may process the executable instructions and/or data structures by remotely accessing the computer program product, for example by downloading the executable instructions and/or data structures from a remote server through the network connectivity devices 392. The computer program product may comprise instructions that promote the loading and/or copying of data, data structures, files, and/or executable instructions to the secondary storage 384, to the ROM 386, to the RAM 388, and/or to other non-volatile memory and volatile memory of the computer system 380.

In some contexts, the secondary storage 384, the ROM 386, and the RAM 388 may be referred to as a non-transitory computer readable medium or a computer readable storage media. A dynamic RAM embodiment of the RAM 388, likewise, may be referred to as a non-transitory computer readable medium in that while the dynamic RAM receives electrical power and is operated in accordance with its design, for example during a period of time during which the computer system 380 is turned on and operational, the dynamic RAM stores information that is written to it. Similarly, the processor 382 may include an internal RAM, an internal ROM, a cache memory, and/or other internal non-transitory storage blocks, sections, or components that may be referred to in some contexts as non-transitory computer readable media or computer readable storage media.

ADDITIONAL DISCLOSURE

The following are non-limiting, specific embodiments in accordance with the present disclosure:

A first embodiment, which is a method of designing a casing string for an oil well, comprising modeling carbon dioxide ($CO_2$) material by a thermodynamic modeling application using a carbon dioxide equation of state (EoS) to determine thermodynamic properties of the $CO_2$ material, wherein the thermodynamic modeling application executes on a computer system, determining temperatures of oil well components by a downhole environment modeling application executing on the computer system at each of a plurality of points of a casing string design based in part on the thermodynamic properties of the $CO_2$ material determined by the thermodynamic modeling application, determining pressures in a casing string by the downhole environment modeling application at each of the plurality of points of the casing string design based in part on the thermodynamic properties of the $CO_2$ material determined by the thermodynamic modeling application, providing the temperatures of oil well components and pressures in the casing string at each of the plurality of points of the casing string by the downhole environment modeling application to a casing string strength analysis application executing on the computer system, analyzing the safety factors of the casing string based on the temperatures of oil well components and pressures in the casing string during a $CO_2$-based completion activity by the casing string strength analysis application, and presenting safety factor reports by the casing string strength analysis application.

A second embodiment, which is the method of the first embodiment, wherein the downhole environment modeling application determines temperatures based in part on a phase of $CO_2$ thermodynamic property.

A third embodiment, which is the method of the second embodiment, wherein the downhole environment modeling application employs a first heat transfer equation associated with a $CO_2$ gas phase, at least in part, to determine temperature where the $CO_2$ has been determined to be in gas phase and employs a second heat transfer equation associated with a $CO_2$ liquid phase, at least in part, to determine temperature where the $CO_2$ has been determined to be in liquid phase.

A fourth embodiment, which is the method of the first, the second, or the third embodiment, wherein the carbon dioxide EoS is a Span-Wagner carbon dioxide EoS.

A fifth embodiment, which is the method of the first, the second, the third, or the fourth embodiment, wherein the $CO_2$-based completion operation is a $CO_2$ injection operation or a $CO_2$ circulation operation.

A sixth embodiment, which is the method of the first, the second, the third, the fourth, or the fifth embodiment, wherein the thermodynamic properties of the $CO_2$ material determined by the thermodynamic modeling application comprise a density, an internal energy, an enthalpy, an entropy, a heat capacity at constant volume, a heat capacity at constant pressure, a Joule-Thomson coefficient, or a speed of sound in the $CO_2$.

A seventh embodiment, which is the method of the first, the second, the third, the fourth, the fifth, or the sixth embodiment, wherein the thermodynamic properties of the $CO_2$ material determined by the thermodynamic modeling application comprise a phase change boundary.

An eighth embodiment, which is the method of the first, the second, the third, the fourth, the fifth, the sixth, or the seventh embodiment, wherein the casing string design is defined by a specification of a wellbore and a casing string, wherein the specification comprises a geothermal gradient, a fracture gradient, a pore pressure gradient, formation types and properties, a well trajectory, a tubing and casing tubular strings size and properties.

A ninth embodiment, which is the method of the first, the second, the third, the fourth, the fifth, the sixth, the seventh, or the eighth embodiment, wherein analyzing the safety factors of the casing string comprises calculating safety factors for a plurality of stress types, where the stress types comprise casing burst strength, casing collapse strength, casing axial strength, and casing triaxial strength.

A tenth embodiment, which is the method of the first, the second, the third, the fourth, the fifth, the sixth, the seventh, the eighth, or the ninth embodiment, wherein determining temperatures of oil well components and determining pressures in the casing string by the downhole environment modeling application comprises performing a thermal flow simulation for each of the plurality of points of the casing string design.

An eleventh embodiment, which is a system for designing a casing string for a well, comprising a processor, a non-transitory memory, a thermodynamic modeling application stored in the non-transitory memory that, when executed by the processor, models carbon dioxide ($CO_2$) material in the well using a carbon dioxide equation of state (EoS) to determine thermodynamic properties of the $CO_2$ material, a downhole environment modeling application stored in the non-transitory memory that, when executed by the processor determines temperatures of well components at each of a plurality of points of a casing string design based in part on the thermodynamic properties of the $CO_2$ material determined by the thermodynamic modeling application, determines pressures in a casing string at each of the plurality of points of the casing string design based in part on the thermodynamic properties of the $CO_2$ material determined by the thermodynamic modeling application, and provides the temperatures of well components and pressures in the casing string at each of the plurality of points of the casing string to a casing string strength analysis application executing on the computer system, and a casing string strength analysis application stored in the non-transitory memory that, when executed by the processor analyzes the safety factors of the casing string based on the temperatures of well components and pressures in the casing string during a $CO_2$-based completion activity by the casing string strength analysis application, and presents safety factor reports by the casing string strength analysis application.

A twelfth embodiment, which is the system of the eleventh embodiment, wherein the downhole environment modeling application determines temperatures based in part on a phase of $CO_2$ thermodynamic property.

A thirteenth embodiment, which is the system of the twelfth embodiment, wherein the downhole environment modeling application employs a first heat transfer equation associated with a $CO_2$ gas phase, at least in part, to determine temperature where the $CO_2$ has been determined to be in gas phase and employs a second heat transfer equation associated with a $CO_2$ liquid phase, at least in part, to determine temperature where the $CO_2$ has been determined to be in liquid phase.

A fourteenth embodiment, which is the system of the eleventh, the twelfth, or the thirteenth embodiment, wherein the carbon dioxide EoS is a Span-Wagner carbon dioxide EoS.

A fifteenth embodiment, which is the system of the eleventh, the twelfth, the thirteenth, or the fourteenth embodiment, wherein the thermodynamic modeling application, the downhole environment modeling application, and the casing string strength analysis application are integrated with each other.

A sixteenth embodiment, which is the system of the eleventh, the twelfth, the thirteenth, the fourteenth, or the fifteenth embodiment, wherein determining temperatures of oil well components and determining pressures in the casing string by the downhole environment modeling application comprises performing a thermal flow simulation for each of the plurality of points of the casing string design.

A seventeenth embodiment, which is a method of designing a casing string for an oil well, comprising modeling carbon dioxide ($CO_2$) material by a thermodynamic modeling application using a Span-Wagner carbon dioxide equation of state (EoS) to determine thermodynamic properties of the $CO_2$ material, wherein the thermodynamic properties comprise at least three members of the list of properties consisting of a density, an internal energy, an enthalpy, an entropy, a heat capacity at constant volume, a heat capacity at constant pressure, and a Joule-Thomson coefficient, wherein the thermodynamic modeling application executes on a computer system, determining temperatures of oil well components by a downhole environment modeling application executing on the computer system at each of a plurality of points of a casing string design based in part on the thermodynamic properties of the $CO_2$ material determined by the thermodynamic modeling application, determining pressures in a casing string by the downhole environment modeling application at each of the plurality of points of the casing string design based in part on the thermodynamic properties of the $CO_2$ material determined by the thermodynamic modeling application, providing the temperatures of oil well components and pressures in the casing string at each of the plurality of points of the casing string by the downhole environment modeling application to a casing string strength analysis application executing on the computer system, analyzing the safety factors of the casing string based on the temperatures of oil well components and pressures in the casing string during a $CO_2$-based completion activity by the casing string strength analysis application, and presenting safety factor reports by the casing string strength analysis application.

An eighteenth embodiment, which is the method of the seventeenth embodiment, wherein the thermodynamic modeling application, the downhole environment modeling application, and the casing string strength analysis application are integrated with each other.

A nineteenth embodiment, which is the method of the seventeenth or the eighteenth embodiment, wherein results of the thermodynamics modeling application are handed-off to the downhole environment modeling application, and the results of the downhole environment modeling application are handed to the casing strength modeling application, A twentieth embodiment, which is the method of the seventeenth, the eighteenth, or the nineteenth embodiment, wherein presenting safety factor reports comprises a safety factor table or a safety envelope graphical depiction of the results of the safety factor table.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

We claim:

1. A method of designing a casing string for an oil well, comprising:

modeling carbon dioxide ($CO_2$) material by a thermodynamic modeling application using a carbon dioxide equation of state (EoS) to determine thermodynamic properties of the $CO_2$ material, wherein the thermodynamic modeling application executes on a computer system;

providing the thermodynamic properties of the $CO_2$ material by the thermodynamic modeling application to a downhole environment modeling application executing on the computer system, whereby the thermodynamic modeling application is integrated with the downhole environment modeling application;

determining temperatures of oil well components by the downhole environment modeling application at each of a plurality of points of a casing string design based in part on the thermodynamic properties of the $CO_2$ material determined by the thermodynamic modeling application;

determining pressures in the casing string design by the downhole environment modeling application at each of the plurality of points of the casing string design based in part on the thermodynamic properties of the $CO_2$ material determined by the thermodynamic modeling application;

providing the temperatures of oil well components and the pressures in the casing string design at each of the plurality of points of the casing string design by the downhole environment modeling application to a casing string strength analysis application executing on the computer system, whereby the downhole environment modeling application and the thermodynamic application are integrated with the casing string strength analysis application;

analyzing a plurality of safety factors of the casing string design based on the temperatures of oil well components and pressures in the casing string design during a $CO_2$-based completion activity by the casing string strength analysis application, wherein the plurality of safety factors comprise a casing burst strength safety factor, a casing collapse strength safety factor, a casing axial strength safety factor, and a casing triaxial strength safety factor;

presenting safety factor reports by the casing string strength analysis application;

receiving input from a user to adapt at least one element of the casing string design;

reiterating the analyzing the plurality of safety factors of the casing string based on the adapted at least one element of the casing string design and based on the temperatures of oil well components and pressures in the casing string design during the $CO_2$-based completion activity by the casing string strength analysis application, whereby to optimize the casing string design.

2. The method of claim 1, wherein the downhole environment modeling application determines temperatures based in part on a phase of $CO_2$ thermodynamic property.

3. The method of claim 2, wherein the downhole environment modeling application employs a first heat transfer equation associated with a $CO_2$ gas phase, at least in part, to determine temperature where the $CO_2$ has been determined to be in gas phase and employs a second heat transfer equation associated with a $CO_2$ liquid phase, at least in part, to determine temperature where the $CO_2$ has been determined to be in liquid phase.

4. The method of claim 1, wherein the carbon dioxide EoS is a Span-Wagner carbon dioxide EoS.

5. The method of claim 1, wherein the $CO_2$-based completion operation is a $CO_2$ injection operation or a $CO_2$ circulation operation.

6. The method of claim 1, wherein the thermodynamic properties of the $CO_2$ material determined by the thermodynamic modeling application comprise a density, an internal energy, an enthalpy, an entropy, a heat capacity at constant volume, a heat capacity at constant pressure, a Joule-Thomson coefficient, or a speed of sound in the $CO_2$.

7. The method of claim 1, wherein the thermodynamic properties of the $CO_2$ material determined by the thermodynamic modeling application comprise a phase change boundary.

8. The method of claim 1, wherein the casing string design is defined by a specification of a wellbore and the casing string, wherein the specification comprises a geothermal gradient, a fracture gradient, a pore pressure gradient, formation types and properties, a well trajectory, a tubing and casing tubular strings size and properties.

9. The method of claim 1, wherein determining temperatures of oil well components and determining pressures in the casing string design by the downhole environment modeling application comprises performing a thermal flow simulation for each of the plurality of points of the casing string design.

10. A system for designing a casing string for a well, comprising:

a processor;

a non-transitory memory;

a thermodynamic modeling application stored in the non-transitory memory that, when executed by the processor, models carbon dioxide ($CO_2$) material in the well using a carbon dioxide equation of state (EoS) to determine thermodynamic properties of the $CO_2$ material and provides the thermodynamic properties of the $CO_2$ material to a downhole environment modeling application, whereby the thermodynamic modeling application is integrated with the downhole environment modeling application;

the downhole environment modeling application stored in the non-transitory memory that, when executed by the processor determines temperatures of well components at each of a plurality of points of a casing string design based in part on the thermodynamic properties of the $CO_2$ material determined by the thermodynamic modeling application, determines pressures in the casing string design at each of the plurality of points of the casing string design based in part on the thermodynamic properties of the $CO_2$ material determined by the thermodynamic modeling application, and provides the temperatures of well components and pressures in the casing string design at each of the plurality of points of the casing string design to a casing string strength analysis application executing on the computer system, whereby the downhole environment modeling application and the thermodynamic modeling application are integrated with the casing string strength analysis application; and the casing string strength analysis application stored in the non-transitory memory that, when executed by the processor analyzes a plurality of safety factors of the casing string design based on the temperatures of well components and pressures in the casing string design during a $CO_2$-based completion activity by the casing string strength analysis application, wherein the plurality of safety factors comprise a casing burst strength safety factor, a casing collapse strength safety factor, a casing axial strength safety factor, and a casing triaxial strength safety factor, presents safety factor reports by the casing string strength analysis application, receives input from a user to adapt at least one element of the casing string design, and reiterates the analyzing the plurality of safety factors based on the adapted at least one element of the casing string design and based on the temperatures of oil well components and pressures in the casing string design during the $CO_2$-based completion activity, whereby to optimize the casing string design.

11. The system of claim 10, wherein the downhole environment modeling application determines temperatures based in part on a phase of $CO_2$ thermodynamic property.

12. The system of claim 11, wherein the downhole environment modeling application employs a first heat transfer equation associated with a $CO_2$ gas phase, at least in part, to determine temperature where the $CO_2$ has been determined to be in gas phase and employs a second heat transfer equation associated with a $CO_2$ liquid phase, at least in part, to determine temperature where the $CO_2$ has been determined to be in liquid phase.

13. The system of claim 10, wherein the carbon dioxide EOS is a Span-Wagner carbon dioxide EoS.

14. The system of claim 10, wherein determining temperatures of oil well components and determining pressures in the casing string design by the downhole environment modeling application comprises performing a thermal flow simulation for each of the plurality of points of the casing string design.

15. The system of claim 10, wherein the casing string design is defined by a specification of a wellbore and the casing string, wherein the specification comprises a geothermal gradient, a fracture gradient, a pore pressure gradient, formation types and properties, a well trajectory, a tubing and casing tubular strings size and properties.

16. A method of designing a casing string for an oil well, comprising:

modeling carbon dioxide ($CO_2$) material by a thermodynamic modeling application using a Span-Wagner carbon dioxide equation of state (EoS) to determine thermodynamic properties of the $CO_2$ material, wherein the thermodynamic properties comprise at least three members of the list of properties consisting of a density, an internal energy, an enthalpy, an entropy, a heat capacity at constant volume, a heat capacity at constant pressure, and a Joule-Thomson coefficient, wherein the thermodynamic modeling application executes on a computer system;

providing the thermodynamic properties of the $CO_2$ material by the thermodynamic modeling application to a downhole environment modeling application executing on the computer system, whereby the thermodynamic modeling application is integrated with the downhole environment modeling application;

determining temperatures of oil well components by the downhole environment modeling application executing on the computer system at each of a plurality of points of a casing string design based in part on the thermodynamic properties of the $CO_2$ material determined by the thermodynamic modeling application;

determining pressures in the casing string design by the downhole environment modeling application at each of the plurality of points of the casing string design based in part on the thermodynamic properties of the $CO_2$ material determined by the thermodynamic modeling application;

providing the temperatures of oil well components and the pressures in the casing string design at each of the plurality of points of the casing string design by the downhole environment modeling application to a casing string strength analysis application executing on the computer system, whereby the downhole environment modeling application and the thermodynamic application are integrated with the casing string strength analysis application;

analyzing a plurality of safety factors of the casing string based on the temperatures of oil well components and pressures in the casing string design during a $CO_2$-based completion activity by the casing string strength analysis application, wherein the safety factors comprise a casing burst strength safety factor and a casing collapse strength safety factor;

presenting safety factor reports by the casing string strength analysis application;

receiving input from a user to adapt at least one element of the casing string design; and reiterating the analyzing the plurality of safety factors of the casing string based on the adapted at least one element of the casing string design and based on the temperatures of oil well components and pressures in the casing string design during the $CO_2$-based completion activity by the casing string strength analysis application, whereby to optimize the casing string design.

17. The method of claim 16, wherein presenting safety factor reports comprises a safety factor table or a safety envelope graphical depiction of the results of the safety factor table.

18. The method of claim 16, wherein the plurality of safety factors further comprise a casing axial strength safety factor and a casing triaxial strength safety factor.

19. The method of claim 16, wherein the casing string design is defined by a specification of a wellbore and the casing string, wherein the specification comprises a geothermal gradient, a fracture gradient, a pore pressure gradient, formation types and properties, a well trajectory, a tubing and casing tubular strings size and properties.

20. The method of claim 16, wherein the thermodynamic properties of the $CO_2$ material determined by the thermodynamic modeling application comprise a density, an internal energy, an enthalpy, an entropy, a heat capacity at constant volume, a heat capacity at constant pressure, a Joule-Thomson coefficient, or a speed of sound in the $CO_2$.

* * * * *